US011024436B2

(12) United States Patent
Crichlow

(10) Patent No.: US 11,024,436 B2
(45) **Date of Patent: *Jun. 1, 2021**

(54) WASTE CAPSULE SYSTEM AND CONSTRUCTION

(71) Applicant: Henry Crichlow, Norman, OK (US)

(72) Inventor: Henry Crichlow, Norman, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/986,024

(22) Filed: Aug. 5, 2020

(65) Prior Publication Data

US 2020/0411206 A1 Dec. 31, 2020

Related U.S. Application Data

(63) Continuation-in-part of application No. 15/936,245, filed on Mar. 26, 2018, now abandoned, and a continuation-in-part of application No. 16/191,390, filed on Nov. 14, 2018.

(51) Int. Cl.

| | |
|---|---|
| ***G21F 9/36*** | (2006.01) |
| ***G21F 5/12*** | (2006.01) |
| ***G21F 5/005*** | (2006.01) |
| ***G21F 5/008*** | (2006.01) |

(52) U.S. Cl.

CPC ..... *G21F 9/36* (2013.01); *G21F 5/005* (2013.01); *G21F 5/008* (2013.01); *G21F 5/12* (2013.01)

(58) Field of Classification Search

CPC ..... G21F 9/36; B09B 1/008
USPC ..... 588/2
See application file for complete search history.

(56) References Cited

U.S. PATENT DOCUMENTS

| | | | | |
|---|---|---|---|---|
| 3,343,607 | A | 9/1967 | Current | |
| 4,868,400 | A | 9/1989 | Barnhart | |
| 5,513,226 | A | 4/1996 | Baxter | |
| 7,096,863 | B2 | 8/2006 | Dossena | |
| 7,220,488 | B2 | 5/2007 | Wadle | |
| 10,427,191 | B2 | 10/2019 | Crichlow | |
| 2019/0177226 | A1 | 6/2019 | Lee | |
| 2019/0295735 | A1* | 9/2019 | Crichlow | G21F 9/36 |
| 2020/0027605 | A1* | 1/2020 | Crichlow | G21F 5/06 |

FOREIGN PATENT DOCUMENTS

WO WO2003077262 A1 9/2003

OTHER PUBLICATIONS

"Technology Development of MMW Directed Energy for Rock Exposure", Paul P. Woskov, Plasma Science and Fusion Center, Massachusetts Institute of Technology, Cambridge MA 02139 USA, Nov. 2014.

"Evaluation of Granite Melting Technique for Deep Borehole Sealing", Minsoo Lee*, Jongyoul Lee, and Sung-Hoon Ji, Korea Atomic Energy Research Institute, 111, Daedeok-daero 989beon-gil, Yuseong-gu, Daejeon, Republic of Korea.

"Millimeter-Wave Directed Energy Deep Boreholes", Paul Woskov, Plasma Science and Fusion Center, Massachusetts Institute of Technology, Cambridge MA 02139 USA , Apr. 2017.

"Electrical Heating", Presented by: Saeid Javidi, Course Instructor: Dr.B.Sedaee Sola, Autumn 2015.

"Electromagnetic Heating of Oil", PetroWiki, https://petrowiki.org/Electromagnetic_heating_of_oil#:~:text=The%20electromagnetic%20heating%20of%20oil,energy%20supplied%20from%20the%20surface.

"Electromagnetic hearing process", Petrowiki, https://petrowiki.org/Electromagnetic_heating_process.

"Experimental melts from crustal rocks: A lithochemical constraint on granite petrogenesis.", Peng Gao , Yong-Fei Zheng, Zi-Fu Zhao, CAS Key Laboratory of Crust-Mantle Materials and Environments, School of Earth and Space Sciences, University of Science and Technology of China, Hefei 230026, China.

"Sealing Deep Borehole Disposals of Radioactive Waste by Rock Welding", Fergus G F Gibb and Karl P Travis, Department of Materials Science & Engineering, The University of Sheffield, Sheffield, UK S1 3JD. F. Gibb@shef.ac.uk; K.Travis@shef.ac.uk.

"Glassy Waste forms for Nuclear Waste Immobilization", Michael Ojovan, William Lee, Metallurgical and Materials Transactions, A vol. 42. 837-851(2011).

"Gyrotron Based Melting", Paul Woskov, Massachusetts Institute of Technology Cambridge, MA USA. 78th Conference on Glass Problems, Columbus Ohio, Nov. 6-9, 2017.

"Gyrotrons", General Features of Gyrotrons, EPFL, https://www.epfl.ch/research/domains/swiss-plasma-center/research/tcv/research_tcv_heating/tcv-ecrh-eccd-system/tcv-gyrotrons/.

"Fate of Tc99 During Waste Processing", Albert A. Kruger, Doe-Wed, Glass Scientist, John Olson, BNI Manager, Process Engineering Design. DOE EM, High Level Waste Corporate Board, Nov. 2010.

"Electromagnetic Heating of Heavy Oil and Bitumen": A Review of Experimental Studies and Field Applications, Albina Mukhametshina1,2 and Elena Martynoval,2, 1 Harold Vance Department of Petroleum Engineering, Texas A&M University, 3116 TAMU-407 Richardson Building, College Station, TX, USA. 2 Gubkin Russian State University of Oil and Gas, 65 Leninsky Prospekt, Moscow, Russia.

(Continued)

*Primary Examiner* — Edward M Johnson
(74) *Attorney, Agent, or Firm* — Eric Kelly

(57) ABSTRACT

Waste capsules for disposal of radioactive materials, including weapons grade plutonium, are made entirely from rock, such as, but not limited to, granite; wherein a cap of such a waste capsule is seamlessly rock welded to a lower body portion of the given waste capsule, to form the given waste capsule, with the radioactive materials inside of a cavity of that waste capsule. The weld region is homogenous with both the cap and the lower body portion. A cooling system may be used during or after rock welding. The sealed and rock welded waste capsule, with the internal radioactive materials, is then loaded into a wellbore system that extends into a deep geological rock repository, thousands of feet below the Earth's surface, such that the waste capsule comes to rest in a wellbore located within the deep geological rock repository. The waste capsule may include insulating material in the cavity.

20 Claims, 11 Drawing Sheets

(56) References Cited

OTHER PUBLICATIONS

Source composition and melting temperatures of orogenic granitoids: constraints from CaO/Na<SUB>2</SUB>O,Al<SUB>2</SUB>O<SUB>3</SUB>/TiO<SUB>2</SUB> and accessory mineral saturation, Article in European Journal of Mineralogy, Nov. 2007, https://www.researchgate.net/publication/272271963.

"Large Granite Blocks", Xiamen SRS Trading Company Ltd. .China.

"Mechanical and Thermal Properties of Ceramics", J.B. Wachtman, Symposium Proceedings at Gaithersburg, Maryland, Apr. 1, 1968. USDoC, National Bureau of Standards.

"Melter Modeling over a Range of Scales to Support Vitrification at the WTP", Donna Post Guillen, Alexander W Abboud, William C. Eaton, Derek Dixon, Richard Pokorny, Kevin Fox, Albert Kruger, S. Luksic., Mar. 2019, Idaho National Laboratory, Idaho Falls, Idaho 83415, , Prepared for the U.S. Department of Energy, Office of Environmental Management, Under DOE Idaho Operations Office , Contract DE-AC07-05ID14517.

The Office of River Protection Cold Cap and Melt Dynamics Technology Development and Research Plan, Apr. 2016, P Hrma DP Guillen et al., Pacific Northwest National Laboratory Idaho National Laboratory. USDoE. DE-AC05-76RL01830.

"Porosity, Permeability, and Their Relationship in Granite, Basalt, and Tuff", Technical Report Apr. 1983, Intera Environmental Consultants^ Inc. 11999 Katy Freeway, Suite 610, Houston, TX 77079.

"Rock Melt Borehole Sealing System", Final Technical Report for SBIR Phase I Grant No. DE-SC0011888, John D Osnes PhD.,Mar. 19, 2015. USDoE, OST. 9800 South Cass Ave, Argone, IL. 60439.

"Thermal treatment of simulant plutonium contaminated materials from the Sellafield site by vitrification in a blast-furnace slag", N.C. Hyatt a, ⇑, R.R. Schwarz a, P.A. Bingham a, M.C. Stennett a, C.L. Corkhill a, P.G. Heath a, R.J. Hand a, M. James b, A. Pearson b, S. Morgan , a Department of Materials Science & Engineering, The University of Sheffield, Mappin Street, Sheffield S1 3JD, UK b Sellafield Ltd., Sellafield, Seascale, Cumbria CA20 1PG, UK c Sellafield Ltd., Hinton House, Risley, Warrington WA3 6GR, UK.

"Gamma Ray Attenuation Properties of Common Shielding Materials", Daniel R. McAlister, Ph.D. PG Research Foundation, Inc. 1955 University Lane Lisle, IL 60532, USA.

"Engineering Compendium on Radiation Shielding", Prepared by: R. G. Jaeger Editor-in-Chief E. P. Blizard t, A. B. Chilton, M. Grotenhuis, A. H6nig, Th. A. Jaeger H. H. Eisenlohr Coordinating Editor International Atomic Energy Agency Vienna, vol. I, Shielding Fundamentals and Methods Springer-Verlag, New York Inc. 1968.

"Use of Electric Downhole Heaters to Improve Production and Recovery of Heavy Viscous oil in California and Venezuela", Samuel A Ojeda et al. SPE 167347. Oct. 2013. Kuwait Conference.

The Spent-Fuel Standard for Disposition of Excess Weapon Plutonium Application to Current DOE Options. Panel to Review the Spent-Fuel Standard for Disposition of Excess Weapons Plutonium Committee on International Security and Arms Control ,National Academy of Sciences, National Academy Press, Washington, DC.

"Technical Evaluation of the U.S. Department of Energy Deep Borehole Disposal Research and Development Program", A Report to the U.S. Congress and the Secretary of Energy, Rodney Ewing Chairman. Jan. 2016.

"Parametric Study of Heavy Oil Recovery by Electromagnetic Heating" M.Y. Liu, and G. Zhao, University of Regina, University of Regina, *Faculty of Engineering and Applied Science, Regina, SK, Canada, S4S 0A2.

"A Comprehensive Review of Thermal Enhanced Oil Recovery: Techniques Evaluation", Feb. 2019, Journal of Energy Resources Technology, Transactions of the ASME 141(3), DOI: 10.1115/1.4041096, Esmail M. A. Mokheimer et al.

"Thermophysical and Mechanical Properties of Granite and Its Effects on Borehole Stability in High Temperature and Three-Dimensional Stress". Wang Yu, et al. ,Key Laboratory on Deep Geo-Drilling Technology of the Ministry of Land and Resources, China University of Geosciences, Beijing 100083, China, State Key Laboratory of Oil & Gas Reservoir Geology and Exploitation, Southwest Petroleum University, Chengdu 610500, China, State Key Laboratory of Petroleum Resource and Prospecting, China University of Petroleum, Beijing 102249, China, Published Mar. 20, 2014.

* cited by examiner

WASTE CAPSULE SYSTEM AND CONSTRUCTION

PRIORITY NOTICE

The present patent application is a continuation-in-part (CIP) of U.S. non-provisional patent application Ser. No. 15/936,245 filed on Mar. 26, 2018, and claims priority to said U.S. non-provisional patent application under 35 U.S.C. § 120. The above-identified patent application is incorporated herein by reference in its entirety as if fully set forth below.

The present patent application is a continuation-in-part (CIP) of U.S. non-provisional patent application Ser. No. 16/191,390 filed on Nov. 14, 2018, and claims priority to said U.S. non-provisional patent application under 35 U.S.C. § 120. The above-identified patent application is incorporated herein by reference in its entirety as if fully set forth below.

CROSS REFERENCE TO RELATED PATENTS

The present application is related to U.S. utility Pat. No. 10,427,191 by the same inventor related to the disposal of nuclear waste in deep underground formations. The disclosure of U.S. utility Pat. No. 10,427,191 is incorporated herein by reference in its entirety.

TECHNICAL FIELD OF THE INVENTION

The present invention relates generally to the design and construction of a waste capsule for the disposal of radioactive nuclear waste material (and/or other waste material); and more particularly, the invention relates to: (a) physical designs and methods of construction of the waste capsule using granitic materials; (b) incorporation of the radioactive waste material (and/or other waste material) into the formed granitic waste capsule; (c) treating of a body of the waste capsule such that a homogenous granitic material is seamlessly formed throughout walls and the body of the given waste capsule; and/or (d) disposal of the given waste capsule in a deep underground geological repository.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Today (circa 2020) there are various quantities of high-level nuclear waste (HLW) products accumulating across the world (Earth). Among the most dangerous waste may be radioactive plutonium. Plutonium has a half-life of can stretch to as long as 24,000 years and must be disposed of very carefully and for a very long time. Radioactive plutonium also has serious war making potential. For example, the United States (U.S.) may have about 34 tons of weapons grade plutonium (WGP) and this material needs to be stored effectively or disposed of. The volumetric equivalent of this material is actually quite small since plutonium is very dense with a density of about 19.8 grams per cubic centimeter (gm/cc).

Currently there are no means contemplated for the disposal (not just mere storage) of plutonium or weapons grade plutonium (WGP), anywhere.

Many existing storage practices for WGP and/or HLW are dangerous, prone to accidents, and open to the possibility of pilferage/theft of the extremely dangerous radioactive material.

In some instances, methods and systems have been theorized and discussed to provide a disposal system in deep rock formations into which a wellbore is implemented. This wellbore is then melted to form a seal to keep the waste buried. There are many problems associated with this type of well bore melted-seals. In most cases this type of technology has a single point of failure. This single point is the wellbore melt itself. If the wellbore melt fails, the whole system is at risk.

In addition, controllably melting the native rock material in real-world wellbores which actually form part of an "infinite" rock matrix which extends in all directions, is almost physically and technologically impossible, because, at least in part, that rock matrix behaves like an infinite heat sink. Operationally, the rock melt operation is complex with needs for controllers at the surface, for downhole heater cables with high density electric currents flowing, for measurement systems and devices. Such operations are costly in the field.

Recent international investigations (e.g., from South Korea), both by empirical studies and laboratory data, may have additionally raised some serious questions about the efficacy and efficiency of the current in-situ rock welding methods implemented in waste disposal methods in sealed wellbore systems. These investigators have indicated that in a real-world situation, the process may be complicated by several factors including and not limited to, in-situ rock fluids, contaminants due to drilling operations, formation pressures, granite recrystallization problems, and other potential drawbacks. Most of these parameters are non-controllable in the typical downhole environment of deep wellbore disposal systems and operations. This complex scenario additionally indicates the need for a new approach to waste capsulation involving rock welding.

Finally, the calculations based on surface computed analytical tools may not translate accurately enough to field conditions thousands of feet below the surface. To solve the above-described problem, the present invention provides methods to utilize a specially designed waste capsule (or waste container) that would allow for safe and economic disposal of the plutonium (and/or similar radioactive substances and/or other waste materials) into deep geological repositories.

There is a long felt, but currently unmet, need for safe methods that would allow disposal of such waste (e.g., HLW and/or WGP) to proceed. Prior methods do not dispose of the weapons grade plutonium (WGP); rather, these prior methods just store the weapons grade waste on the surface of the Earth.

It may be desired that radioactive materials be sequestered at a considerable enough distance below the surface of the Earth to maintain the highest level of safety as possible.

A need, therefore, exists for a new method and system to safely dispose of weapons grade plutonium (WGP) and/or other high-level nuclear waste (HLW) in physical systems which are safe and then depositing these specially designed systems (e.g., waste capsules) in a method that is designed to meet the requirements of public acceptance along with regulatory guidelines.

Today (2020), no attempt has been made to design or construct a rock-based waste capsule apparatus or device that conceptually resembles the way in which a natural granite rock formation would behave, if that rock formation material had a naturally formed internal cavity for receiving/containing waste material. This novel rock-based waste capsule proposed herein, may mimic a natural geode. Geodes are the nearest natural counterpart of the inventive concept discussed herein. Geodes are spherical to subspherical rock structures with an internal cavity lined with mineral materials. Geodes have a durable outer wall that is more resistant to weathering than the surrounding bedrock. This allows the geode to survive intact for a very long time when the surrounding bedrock weathers away. The physical size of the inventive waste capsules under discussion in this application are generally much larger than typical geodes found in nature.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe and define methods and systems for rock-based waste capsules that would permit the disposal of plutonium and/or weapons grade material (WGP) wastes and/or high level waste (HLW) in deep geological formations (repositories).

The present invention may relate to designing systems and methods to utilize a container (waste capsule), substantially constructed of a rock material(s) (e.g., granite) which may be at least substantially, identical in properties, both physically and chemically, to at least some natural rock material(s) (e.g., granite). Today, most scientists agree, that radioactive (and/or other) dangerous waste materials should be sequestered deep in the Earth's crust, preferably in igneous or granitic rock formations.

In some embodiments, waste disposal systems contemplated herein, may comprise a granitic waste capsule, substantially a cylindrical or prismatic rectangular form, of integral design, constructed from a single block of native granite. Native granite being described herein as granite rock usually cut or quarried from a geologic site which has been formed or created by natural processes or actions over millions of years.

In general, granite is a light-colored igneous rock formed from the slow crystallization of liquid magma in the Earth. Grains of granite may be large enough to be visible with the unaided eye. Granite is composed mainly of quartz and feldspar with minor amounts of mica, amphiboles, and other minerals. The granite porosity and permeability may vary depending on the location, depth of burial, and the external and internal stresses imposed on the rock which may cause fractures in the rock matrix. The granite in its block form may be machined into the preferred shapes/forms utilized in this invention (such as, but not limited to cylinders closed on at least one end and/or rectangular prisms closed at least on one end).

In some embodiments, an inventive method contemplated herein, may be expressed as a sequence of one or more of the following steps: (a) forming (e.g., via machining) a waste capsule apparatus from a granite block with a disposed internal cavity; (b) forming a cap for the above formed waste capsule; (c) installing (loading) the given waste material into the internal cavity of the formed waste capsule; (d) installing insulation material above (with) the waste material within the internal cavity of the given waste capsule; (e) installing the formed capsule cap to seal up the internal cavity (with the waste material and/or with the insulating material); (f) installing/implementing a rock welding system to waste capsule with cap (which may include a cooling system in some embodiments); (g) rock welding the cap to the waste capsule, using the rock welding system; (h) cooling the waste capsule that was previously rocked welded; (i) removing the rock welding system from the waste capsule; and/or (j) disposing of the seal waste capsule in a deep geological repository; combinations thereof; and/or the like. In some embodiments, one or more of these steps may be omitted and/or repeated.

The novel teachings of this patent application provide systems and methods which may be easily scaled today to an industrial level similar to an assembly line operation in which the granite melted waste capsules may be produced in large quantities, of several thousand waste capsules (or more) based on need (demand). Each such waste capsule may behave as a separate and individual "minute repository" with its own quantum of waste (WGP and/or HLW) disposed inside the waste capsule internal cavity.

Compared to the prior technologies in which a single wellbore is rock-welded at some specific depth to form a continuous horizontal rock layer enclosing the waste therebelow in the wellbore, the contemplated inventive described herein are far superior operationally, economically, and with respect to safety. With respect to the prior technologies, forming a rockweld in a deep wellbore requires the transmission of high density electric current for many days or weeks in a steel wellbore and directing such generated resistive heat flux radially into an essentially infinite heat-absorbing rock medium; and as such, it is difficult to effectively concentrate the heat flux at a specific point in an underground formation rock matrix.

Further, with respect to the prior technologies, such single-weld operations are dangerous because of the potential for electrical short circuits in a metal wellbore which can literally melt the steel casing. The prior technologies require costly amounts of surface personnel; detailed continuous controlling of the applied electrical current; and above all, provides a significant "single source of failure" at the connecting (intervening) wellbore to the surface of the Earth. Any failure in this single wellbore element ruins the whole disposal process with all the tons of waste material disposed below the weld point thus becoming unprotected and allowing migration and leaching away from the disposal site. There is no redundancy in the prior technologies systems of formation rock-welding which uses a single wellbore for disposal and also for communication with the surface of the Earth.

This novel assembly line approach taught herein can provide for cost optimization in a controlled environment, can provide redundancy safely by utilizing many assembly lines or "trains" of operation and safely can be effectively maintained with respect to worker safety and the storage of waste capsules and waste material. The process can effectively utilize existing robotic assembly methods and control systems thus limiting human safety issues and problems and decreasing costs while maximizing throughput of capsules.

The implementation of this novel technology including the ability to utilize robotics can precisely perform the mundane and repetitive operations needed to construct the granitic waste capsules and to implement the disposal processes.

It is an objective of the present invention to dispose of any contemplated waste (such as, but not limited to, WGP and/or HLW) within at least one deep geological repository (formation).

It is another objective of the present invention to dispose of radioactive materials at a considerable enough distance below the surface of the Earth to maintain the highest level of safety as possible.

It is another objective of the present invention to provide a method for efficiently rock welding a given waste capsule in a manner that allows for large scale implementation of thousands of such waste capsules in an assembly line type operation or the like.

It is yet another objective of the present invention to utilize electric resistive heater systems, electromagnetic driven heater systems (Gyrotron or the like), combinations thereof, and/or the like in the rock welding processes.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention. Figures may not be to scale.

FIG. 1A may also include a sectional line, line B-B.

FIG. 1B may depict the transverse-width cross section of the waste capsule of FIG. 1A when the waste capsule is at least substantially shaped as a right cylinder from its exterior.

REFERENCE NUMERAL SCHEDULE

Figure 1A:
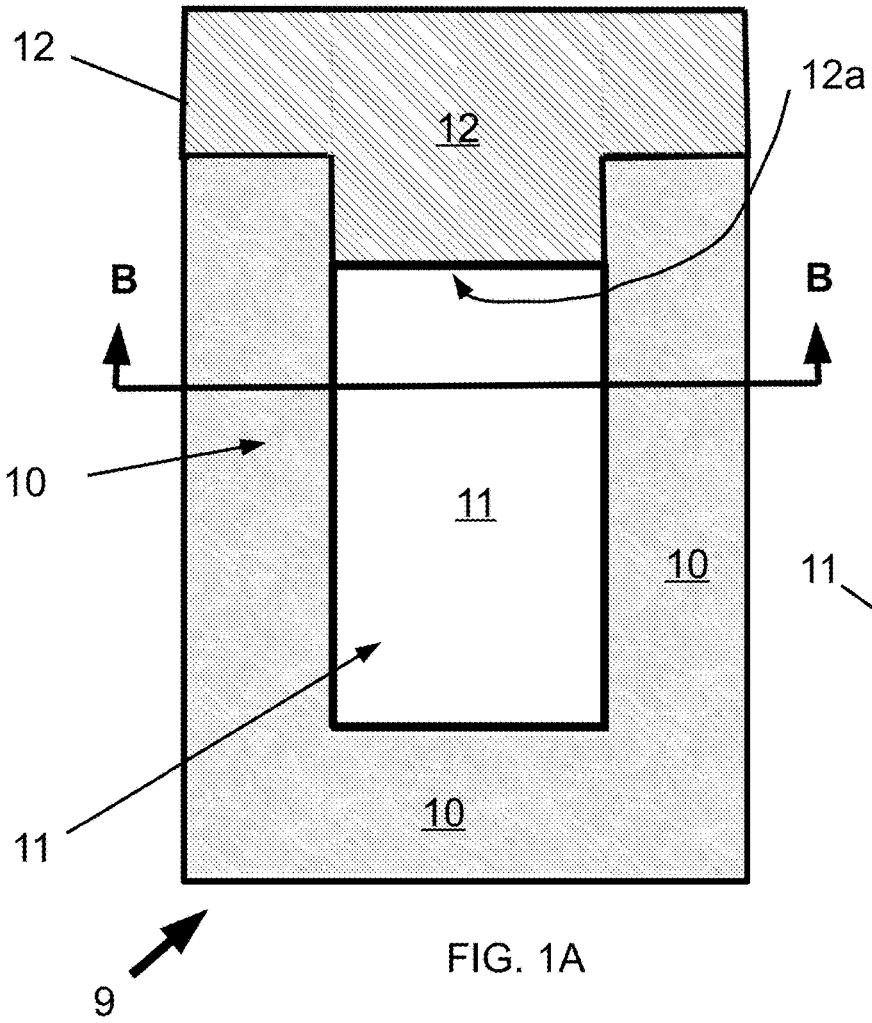
FIG. 1A may depict a longitudinal cross-section diagram of a (granitic) waste capsule (with walls, cap, and internal cavity) as contemplated herein.

8 granite block 8
9 waste capsule 9
9*a* segment 9*a*
9*b* linear (vertical) length 9*b*
9*c* outer diameter (or width) 9*c*
9*d* wall thickness 9*d*
9*e* outer protective sheath 9*e*
9*f* junction 9*f*
10 wall 10
10*a* height 10*a*
10*b* length 10*b*
10*c* width 10*c*
11 cavity 11
12 cap 12
12*a* insert 12*a* (of cap 12)
13 waste material 13
14 insulation material 14
15 heater system elements 15
15*a* cooling system 15*a*
16*a* (electric resistive) heater power and controller 16*a*
16*b* (electric) heater cable 16*b*
17*a* MMW power control 17*a*
17*b* MMW connectors 17*b*
17*c* MMW heat element 17*c*
18 confining pressure 18
19 representative isotherm lines 19
20 melted and re-solidified rock region 20
20*a* demarcation zone/line 20*a*
21 wellbore 21

22 wellbore casing 22
23 wellbore cement 23
24 capsule separator 24
25 formation rock 25
700 method of rock welding and disposing waste capsule 700
701 step of determining and analyzing operational parameters 701
702 step of forming waste capsule from block granite 702
703 step of constructing and fitting cap 703
704 step of installing waste in cavity of capsule 704
705 step of introducing insulation material in capsule cavity 705
706 step of installing heater system on capsule 706
707 step of installing cooling system on capsule 707
708 step of applying external axial pressure to capsule 708
709 step of activating and running heater system 709
710 step of rock welding capsule 710
711 step of cooling capsule 711
712 step of removing heater and cooling 712
713 step of disposing welded capsules in disposal wellbore system 713
714 step of sealing wellbore 714

DETAILED DESCRIPTION OF THE INVENTION

In this patent application, "waste," "waste products," "waste material," or the like, may refer to: plutonium, weapons grade plutonium (WGP), weapons grade components, high level nuclear waste (HLW), radioactive material, radioactive product, radioactive waste, combinations thereof, and/or the like.

In this patent application, the terms "capsule" and/or "container" (e.g., as in "waste capsule" or "waste container") may refer to a device (apparatus) which may contain, receive, house, store, and/or hold a given predetermined amount of the waste product. In some embodiments, such "capsules" and/or "containers" may comprise an internal and/or an integral "cavity" for the containing, receiving, housing, storing, and/or holding of the given pre-determined amount of the waste product.

In this patent application, "formation rock" and/or "repository" may be used interchangeably; and may refer to a rock structure within a deep geological formation (e.g., thousands of feet below the terrestrial surface) that may be hosting (housing) one or more wellbores and/or human-made caverns. These repository formations may be between 10,000 feet and 25,000 feet below the surface of the Earth, plus or minus 1,000 feet.

In this patent application, the terms "well" and "wellbore" may be used interchangeably and may refer to cylindrical drilled out elements implemented in design and/or installation processes of some embodiments of the present invention. The term "wellbore packer," "packer," "wellbore seal," may be used interchangeably to mean a sealing device or system to seal the internal bore of a given wellbore.

In this patent application, the terms "single well" or "common well" may refer to a wellbore that may be shared.

In this patent application, "vertical wellbores" need not be geometrically perfectly vertical (parallel) with respect to the Earth's gravitational field; but rather may be substantially (mostly) vertical (e.g., more vertical than horizontal with respect to Earth's terrestrial surface).

In this patent application, the terms "rock welding," "rock weld," and/or "rockmelting" may describe a process in which rock material(s) may be heated to its melting point (e.g., in the same manner in which a typical metal may be heated to its melting point) and subsequently allowing the melted rock material to coalesce, forming a substantially homogenous medium throughout the welded rock material. The granitic material(s) described in this patent application may have melting points of approximately 700 degrees Celsius to 830 degrees Celsius depending on a given confining pressure.

The heat energy needed for rock welding may be generated by various sources and/or devices. Principally, electric resistive heaters were the norm in the past and may still be used. Today (2020) an additional heater type is available. It is a heater powered by a Gyrotron. Gyrotrons are devices that are sources of powerful electromagnetic waves (beams) and these intense beams in the millimeter-wave (MMW) range of the electromagnetic spectrum may be utilized to rapidly heat and melt even dense, crystalline, and/or opaque materials.

By using the Gyrotron system, non-contact or close contact superficial heating to relatively high temperatures are possible. Temperatures above the melting points of igneous rocks like granite are readily possible with Gyrotron based heating systems. This type of system may be utilized for the type of granite rock heating operation illustrated and implemented in this patent application in some embodiments.

In recent studies, experimental empirical work using gyrotrons at 28 GHz (gigahertz) with up to 5 kW (kilowatts) of power in 50 mm (millimeter) spot sizes have been shown to rapidly heat and melt crystalline rock materials as high as 3,000 degrees Celsius in a matter of minutes. However, it should be noted in the granite melt systems embodied in this application, these extremely high temperatures may not be required.

Today (2020), commercially available now are Gyrotron sources of intense millimeter-wave (MMW) power in the frequency range of 30 to 300 GHz, in nominal power increments from 10 kW to 2 MW (megawatts). With these energy (heat) sources it is possible to directly deposit energy into targeted materials to rapidly heat to high temperatures that melt hard rock materials. In some embodiments, significant granite melting can be achieved in less than 15 minutes of heating time.

The MMW electromagnetic frequency range is ideally suited for applications in granite melting because the operating wavelengths are long enough to propagate through optically dense materials that would impede other infrared radiation. A 28 GHz Gyrotron with up to a 5 kW diverging beam may be launched from a waveguide with as small as a 20 mm internal diameter and may be used for melting several rock types including granite.

In this patent application, Gyrotron based heaters (or the like) may be referred to as MilliMeter Wave (MMW) heaters.

In this patent application, "heat elements," "heater elements," "heating elements," or the like, may be electric resistive type heating elements, MMW heating elements, combinations thereof, and/or the like.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1A may depict a longitudinal cross-section diagram of a (granitic) waste capsule 9 (with walls 10, cap 12, and internal cavity 11). FIG. 1A may also include a sectional line, line B-B. across a transverse width (or diameter) of waste capsule 9. In some embodiments, waste capsule 9 may be substantially constructed from one or more rocks, such as, but not limited to granite. In some embodiments, waste capsule 9 may be substantially cylindrical in exterior shape (see e.g., FIG. 1B) or substantially shaped as rectangular prism in exterior shape (see e.g., FIG. 1C). Internally, waste capsule 9 may comprise a void volumetric region designed herein as cavity 11. In some embodiments, cavity 11 may be an elongate member of a fixed length and with a fixed diameter, i.e., an inner diameter of waste capsule 9. Cavity 11 may be configured to receive contemplated amounts of waste materials, such as, but not limited to, WGP, HLW, combinations thereof, derivatives thereof, and/or the like. In some embodiments, sides of cavity 11 may be bound by wall(s) 10. In some embodiments, a bottom of cavity 11 may be bound by wall 10. In some embodiments, a base (bottom) of waste capsule 9 and wall(s) 10 may be formed seamlessly from a single block of granite by coring, cutting, machining operations to the given single block of granite, see e.g., FIG. 1D and FIG. 1E. In some embodiments, a top of cavity 11 may be bound by cap 12. In some embodiments, cap 12 may be (firmly/snugly) attached to a top of wall(s) 10 and cavity 11, thereby sealing cavity 11. In some embodiments, cap 12 may be rock welded to a top of wall(s) 10 and/or a top of cavity 11, thereby sealing cavity 11. In some embodiments, cap 12 may have an insert 12*a* configured to fit inside of an upper portion of cavity 11. In some embodiments, a cross-sectional diameter of cavity 11 may be fixed and static. In some embodiments, a cross-sectional diameter of cavity 11 may be selected from a range of five (5) inches to nine (9) inches, plus or minus one (1) inch. In some embodiments, wall(s) 10 and/or cap 12 may be formed (constructed) from one or more rocks, such as, but not limited to granite. In some embodiments, an outer width or an outer diameter of cap 12 may be substantially the same as an outer width or an outer diameter of side wall(s) 10 of waste capsule 9. In some embodiments, waste capsule 9 may comprise wall(s) 10, cavity 11, and cap 12.

Figure 1B:
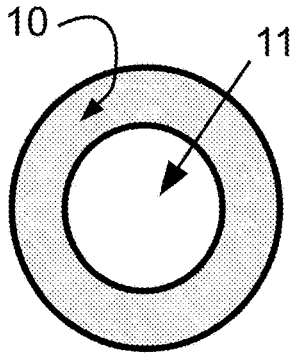
FIG. 1B may depict a transverse-width cross section along sectional line, line B-B from FIG. 1A.

FIG. 1B may depict a transverse-width cross section of waste capsule 9 along sectional line, line B-B from FIG. 1A. FIG. 1B may depict the transverse-width cross section of waste capsule 9 when waste capsule 9 may be at least substantially shaped as a right cylinder from its exterior. Note, cap 12 is omitted in FIG. 1B.

Figure 1C:
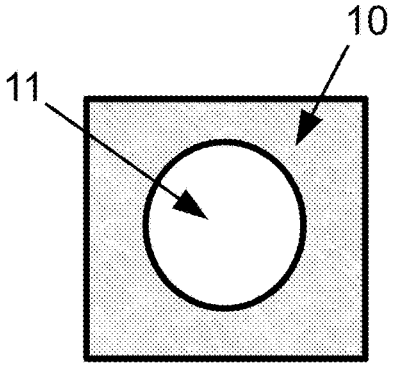
FIG. 1C may depict the transverse-width cross section of the waste capsule of FIG. 1A when the waste capsule is at least substantially shaped as a rectangular prism from its exterior.

FIG. 1C may depict a transverse-width cross section of waste capsule 9 when waste capsule 9 may be at least substantially shaped as a rectangular prism from its exterior. Note, cavity 11 may still be substantially cylindrical in shape when wall(s) 10 and base/bottom may be exteriorly shaped as a rectangular prism.

Figure 1D:
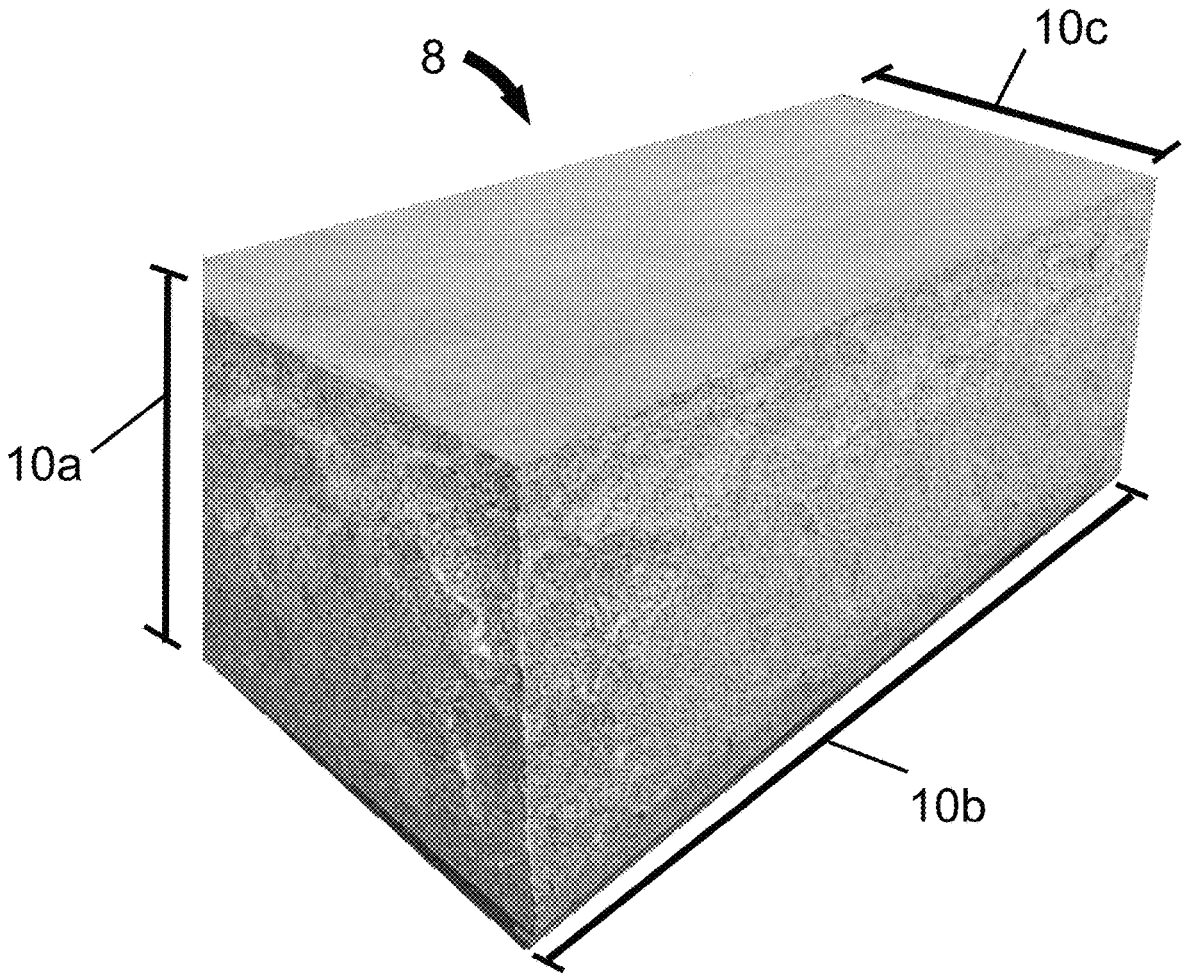
FIG. 1D may depict a perspective view of a (quarried) granite block (e.g., in rectangular prism form).

FIG. 1D may depict a perspective view of a granite block 8 (e.g., in rectangular prism form). In some embodiments, granite block 8 may be substantially as quarried and/or substantially as prepared for use in industry. In some embodiments, granite block 8 may be substantially commercial grate. In some embodiments, granite block 8 may have a height 10*a*, a length 10*b*, and a width 10*c*. For a given granite block 8, height 10*a*, length 10*b*, and width 10*c* may be fixed. In some embodiments, one or more waste capsule(s) 9 may be formed (e.g., machined, cored, cut, grinded, abrasion blasted, polished, combinations thereof, and/or the like) from a given granite block 8 (see e.g., FIG. 1E).

Figure 1E:
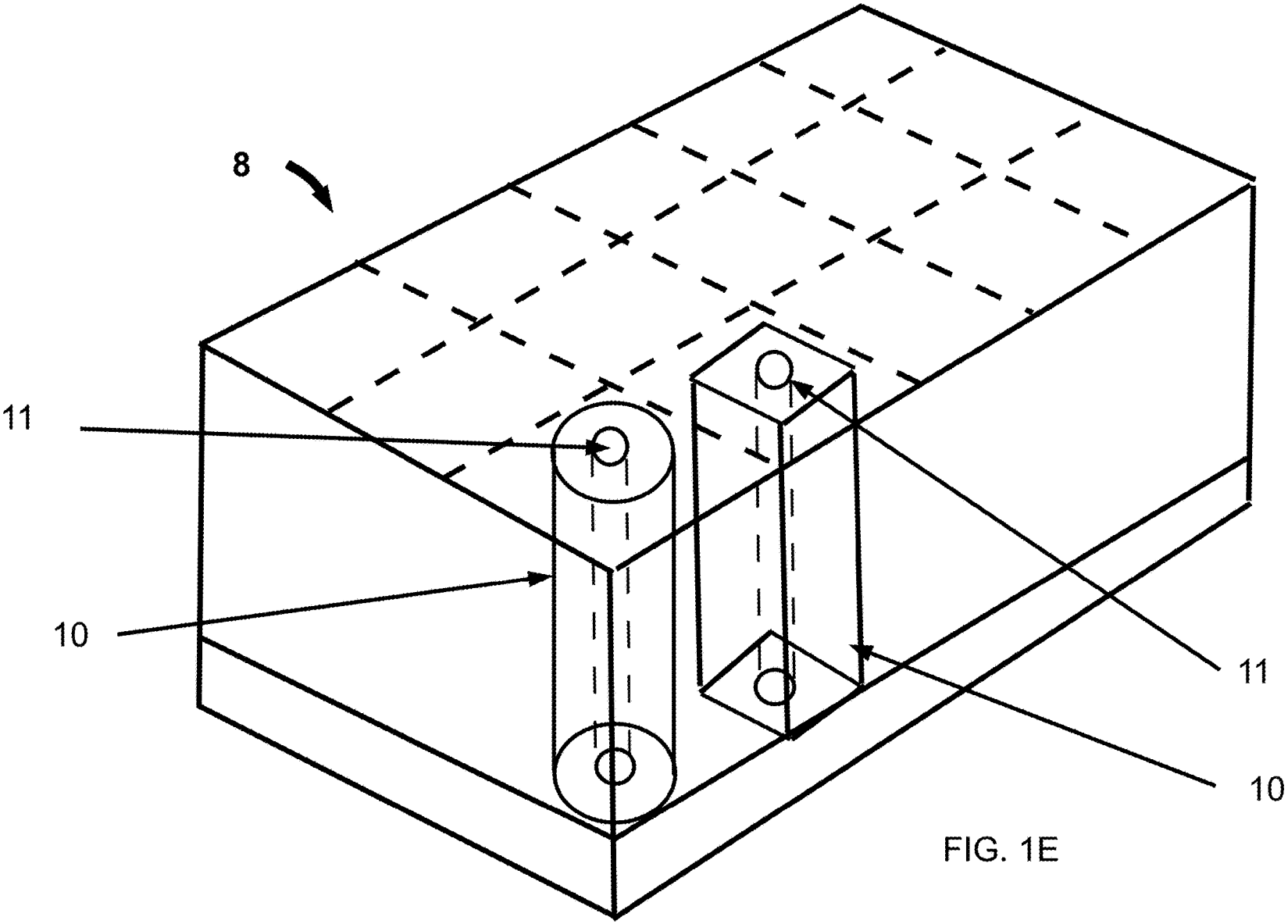
FIG. 1E may depict how various granitic waste capsules may be formed (machined) from a larger block of granite.

FIG. 1E may depict how various granitic waste capsules 9 may be formed (machined) from granite block 8. Substantially cylindrical exteriorly shaped waste capsules 9 and/or substantially rectangular prism exteriorly shaped waste capsules 9 may be formed from a given granite block 8. Various cylindrical core barrels and/or cutting saws may be used to cut and shape the general exterior shapes of waste capsules 9 in this phase of the operations. Cavities 11 may also be substantially formed in this stage.

Figure 2:
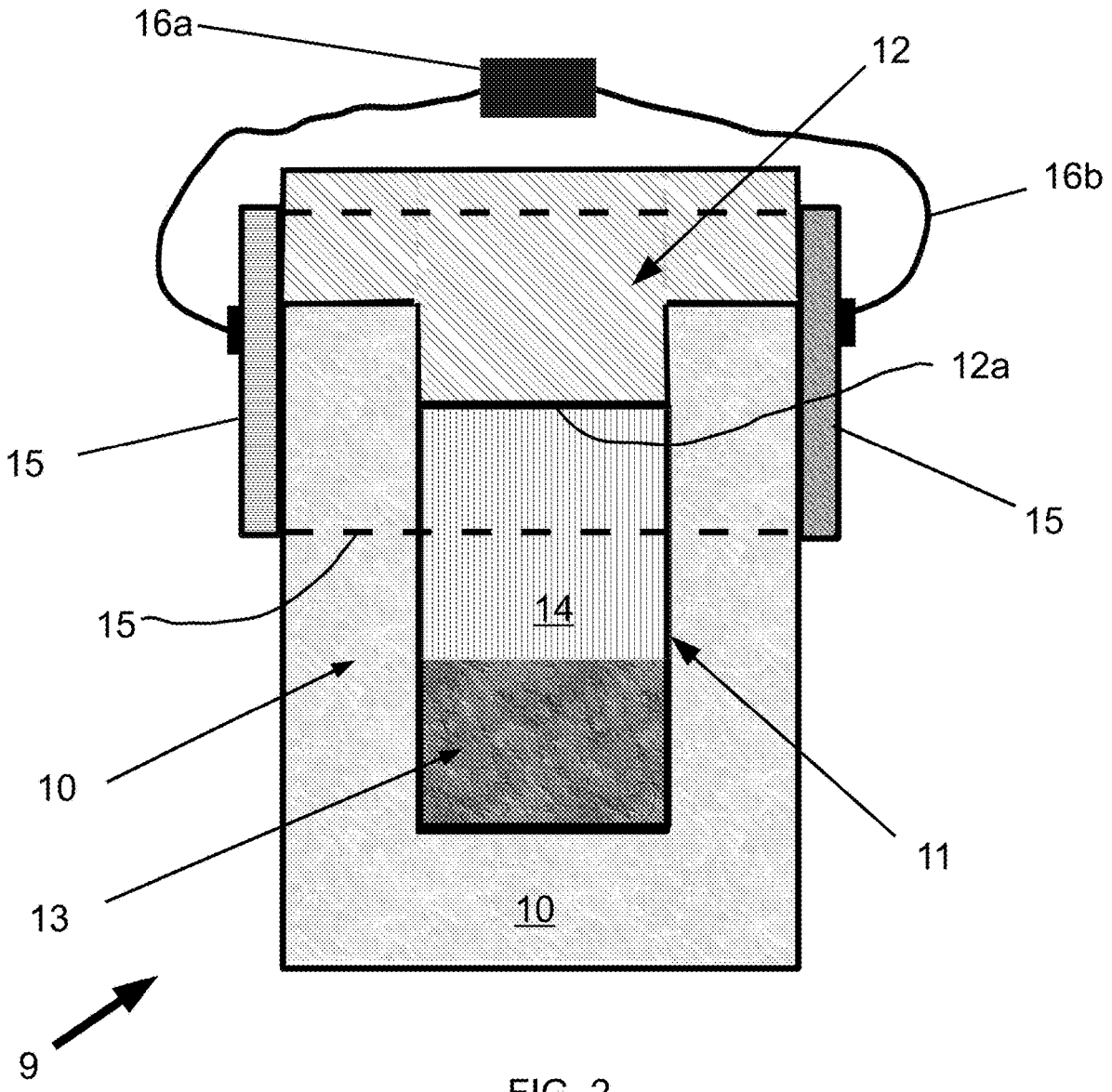
FIG. 2 may depict a longitudinal cross-section diagram of a (granitic) waste capsule fitted with (an electric resistive) rock welding system.

FIG. 2 may depict a longitudinal cross-section diagram of a (granitic) waste capsule 9 fitted with (an electric resistive or equivalent or better) rock welding system. In some embodiments, a different type of rock welding system may be implemented. In some embodiments, this rock welding system may be used to rock weld cap 12 to a top of wall(s) 10 and/or to a top of cavity 11. In some embodiments, prior to such rock welding, a predetermined amount of waste material 13 may be loaded into a bottom of cavity 11. In some embodiments, waste material 13 may be selected from one or more of: WGP, HLW, radioactive materials, radioactive products, radioactive waste, waste pellets, waste blocks, fuel pellets, fuel rods, spent fuel assemblies, waste, portions thereof, combinations thereof, derivatives thereof, and/or the like. In some embodiments, waste material 13 may be dangerous. In some embodiments, waste material 13 may be a waste that is desired to be disposed of.

Continuing discussing FIG. 2, in some embodiments, after loading the predetermined amount of waste material 13 into cavity 11, insulation material 14 may be loaded into cavity 11. In some embodiments, insulation material 14 may cover over at least some of the 13 within cavity 11. In some embodiments, insulating material 14 may be inserted above the waste material 13 in cavity 11. In some embodiments, insulating material 14 may have a melt temperature and/or a burn/combustion temperature that is (significantly) higher than a melt temperature of granite, at a given amount of confining pressure. In some embodiments, this insulating material 14 may be asbestos or some similar minimal heat conducting and heat resistant material. In some embodiments, this insulating material 14 may work by limiting/restricting/slowing vertical heat conduction in cavity 11 of the given waste capsule 9 during the rock welding operation that seals cap 12 to that waste capsule 9; and thus, prevents the waste material 13 from melting during that rock welding process by keeping the waste material 13 temperature below the melting point of the waste material 13. In some embodiments, insulating material 14 may remain inside cavity 11 and may be disposed of along with waste material 13.

Continuing discussing FIG. 2, in some embodiments, inclusion/use of insulating material 14 above waste material 13 in cavity 11 may be omitted. In some embodiments, waste material 13 may have a melting point significantly higher than that of granite and as such there may be little or no need for inclusion/use of insulating material 14 above waste material 13 in cavity 11. In some embodiments, depending on the type of waste material 13 and its particular waste form, such as, but not limited to, fuel pellets, fuel rods, spent fuel assemblies, and like, wherein these waste components or parts may also include steels (e.g., with a melting point 1,510 degrees Celsius) and/or zircalloy (e.g., with a melting point 1,850 degrees Celsius), which have melting points far above that of granite. In those cases where the melting point of waste material 13 is significantly higher that of the granite, there may be no or minimal need for insulating material 14, since the melting point of the granite may be about 830 degrees Celsius (note, significantly higher in this context may mean at least 150 degrees Celsius higher in terms of waste material 13 melt point).

Continuing discussing FIG. 2, in some embodiments, cap 12 may be made or machined from the same material granite (or substantially the same) as wall(s) 10. In some embodiments, cap 12 may fit snugly into the top of the cavity 11 and cap 12 insert 12*a* may extend partially into the top of cavity 11. In some embodiments, cap 12 may cover the top of waste capsule 9. In the rock welding process, parts/portions of capsule cap 12 may be melted and become homogenous blending seamlessly with at least some upper/top portion of wall(s) 10 of the given waste capsule 9. Such rock welding of cap 12 to wall(s) 10 may result in waste material 13 being entirely and seamlessly sealed within cavity 11 of that waste capsule 9.

Continuing discussing FIG. 2, in some embodiments, the rock welding system may comprise heater system elements 15, heater cable(s) 16*b*, and at least one heater power and controller 16*a*. In some embodiments, the rock welding system (e.g., heater system elements 15, heater cable(s) 16*b*, and at least one heater power and controller 16*a*) may be electrically powered. In some embodiments, heater cable(s) 16*b* may be physically and operatively connected to both heater system elements 15 and to at least one heater power and controller 16*a*. In some embodiments, heater cable(s) 16*b* may be configured to transmit/conduct electrical power/energy. In some embodiments, heater system elements 15 may be configured to emit heat upon receiving electrical current from heater cable(s) 16*b*. In some embodiments, heater system elements 15 may be attached and/or in physical contact with exterior portions of wall(s) 10 and/or cap 12. In some embodiments, heater system elements 15 may be (removably in some embodiments) implemented circumferentially on the outside perimeter of waste capsule 9, at a vertical level that may include and encompass portions of cap 12 and wall(s) 10. In some embodiments, heater system elements 15 may directed and configured to emit sufficient heat to seamlessly weld cap 12 to wall(s) 10. The broken horizontal lines in FIG. 2 may indicate portions of heater system elements 15 going around the upper portions of side wall(s) 10. In some embodiments, at least one heater power and controller 16*a* may be a power supply and/or may regulate transmission of electrical power to heater system elements 15 via heater cable(s) 16*b*. In some embodiments, at least one heater power and controller 16*a* may comprise a thermostat and/or at least one temperature sensor/probe configured to sense a temperature of one or more of: heater system elements 15, cap 12, insert 12*a*, wall(s) 10, cavity 11, heater cable(s) 16*b*, portions thereof, combinations thereof, and/or the like. In some embodiments, the rock welding system (via heater system elements 15, heater cable(s) 16*b*, and at least one heater power and controller 16*a*) may provide the necessary heat to weld cap 12 to the top of wall(s) 10.

In some embodiments, the rock welding system may utilize other than electrical heating means, such as, but not limited to, chemical powered means, such as combustion based systems using gas or fluid based fuels, and/or from general exothermic chemical reactions. In some embodiments, as discussed later, electromagnetic heating using millimeter wave (MMW) systems (such as, but not limited to, Gyrotron based, or the like) may be utilized to generate and direct the heat needed to melt the granite capsule material (wall) 10.

In some embodiments, after the given rock welding operations are completed, the rock welding system may be removed from the given waste capsule 9 (and re-used on another waste capsule 9). In some embodiments, after the given rock welding operations are completed, the rock welding system may be disposed of along with the seamless sealed waste capsule 9 within a given wellbore 21, within a deep geological repository 25, i.e., the rock welding system (or portions thereof) may be disposed of (i.e., may be disposable).

Figure 3:
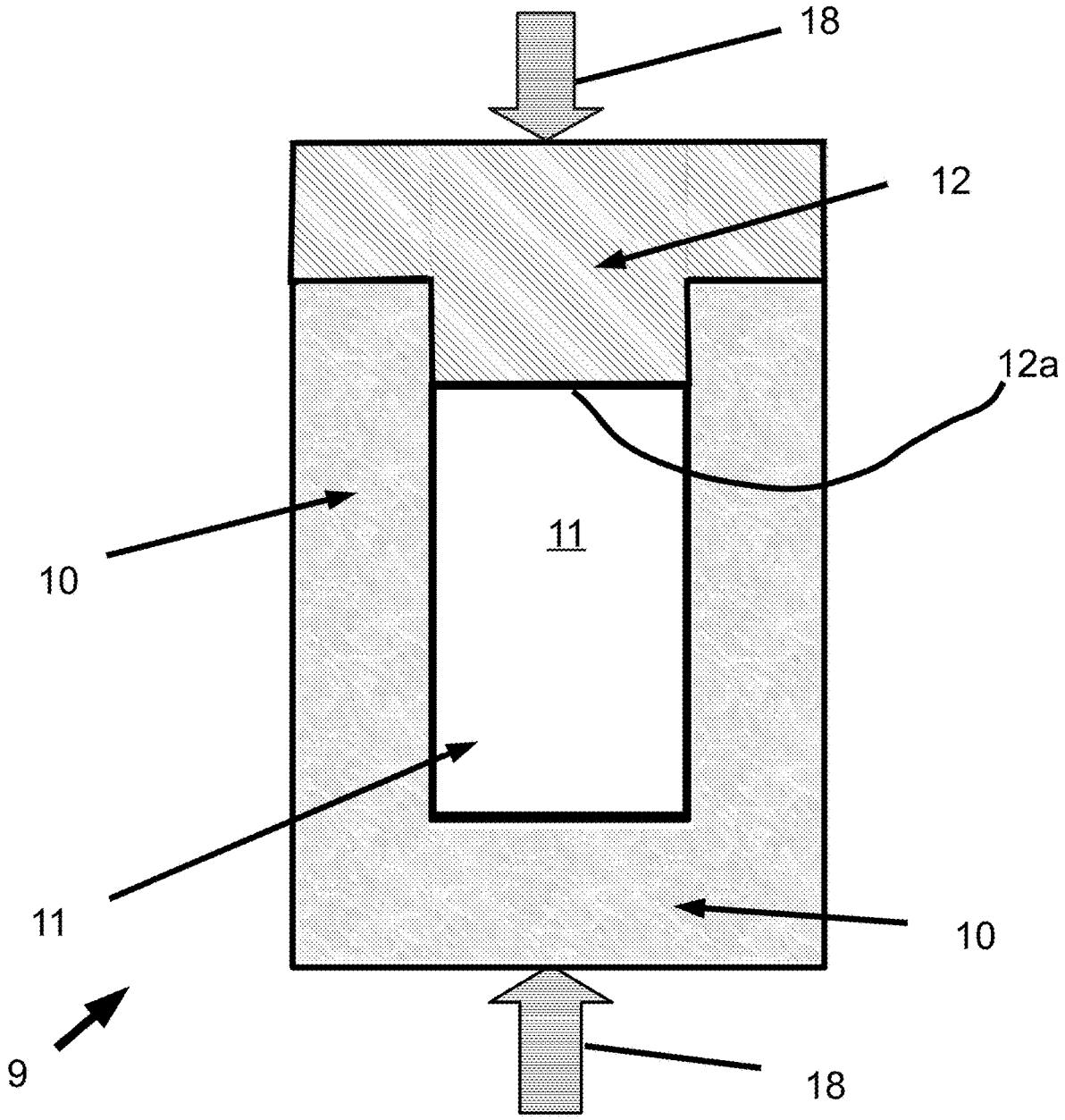
FIG. 3 may depict a longitudinal cross-section diagram of a (granitic) waste capsule being exposed to pressure loads at a top and/or at a bottom of the given waste capsule.

FIG. 3 may depict a longitudinal cross-section diagram of a (granitic) waste capsule 9 being exposed to pressure loads (e.g., confining pressure 18) at a top and/or at a bottom of the given waste capsule 9, wherein such pressure loads may facilitate the rock welding operations shown in FIG. 2. In some embodiments, waste capsule 9 (with waste material 13 and/or with insulating material 14) may be pre-loaded axially (i.e., at its opposing ends) by a significant vertical pressure (force) (e.g., up to several thousand psi [pounds per square inch]) shown in diagrammatic form by confining pressure 18. In some embodiments, confining pressure 18 may be imposed by mechanical and/or hydraulic means on the top and bottom of the given waste capsule 9. It has been demonstrated in practice that pre-loading of the granite wall(s) 10 with cap 12 lowers a melting point of the granite material; and thus, making for more efficient welding of the elements of granitic material of waste capsule 9 which may now occur at a lower temperature. In some embodiments, application of such confining pressure 18 to the given waste capsule 9 may occur before the rock welding operations and/or may occur simultaneously with the rock welding operations.

Figure 4A:
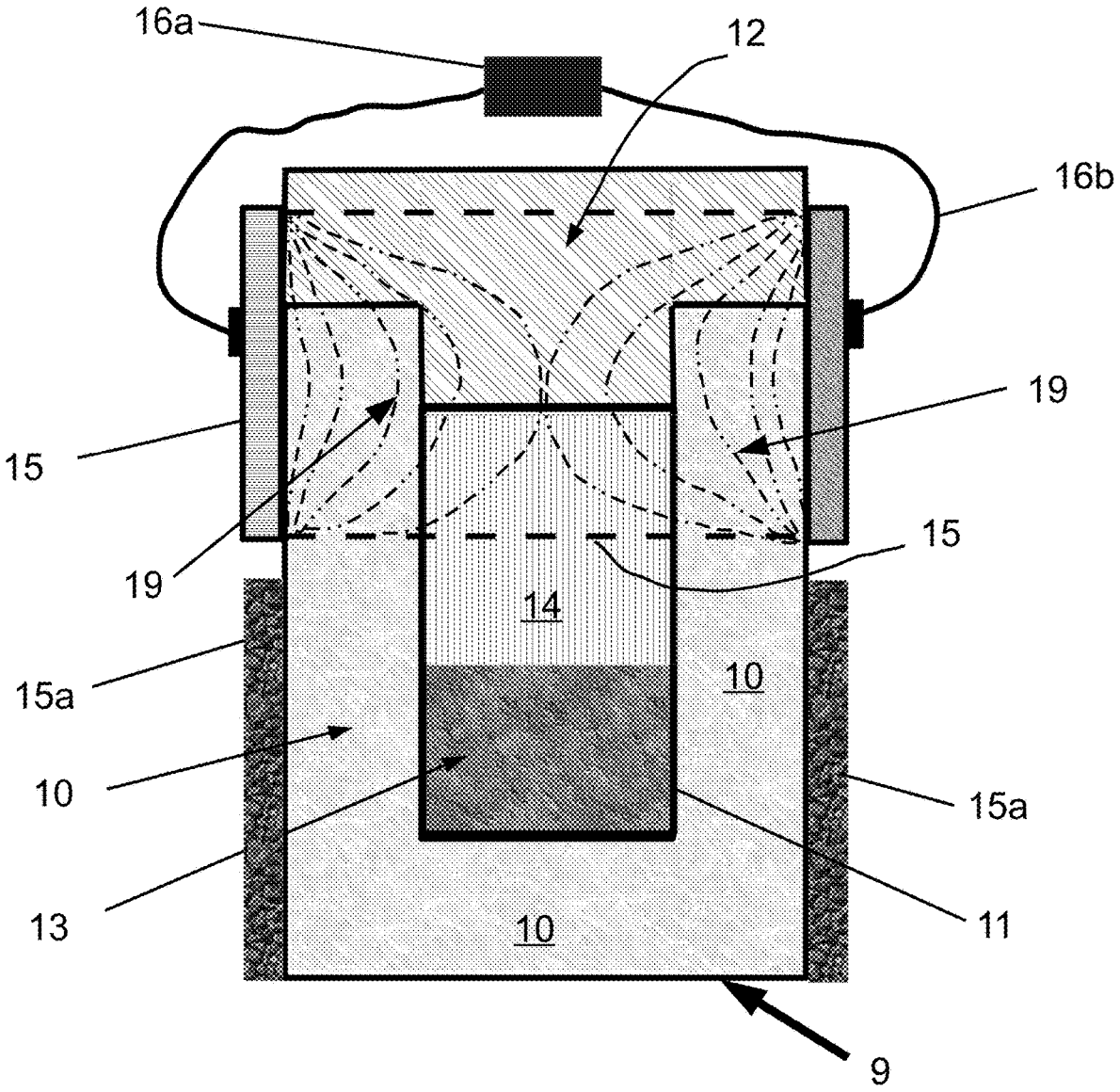
FIG. 4A may depict a longitudinal cross-section diagram of a (granitic) waste capsule fitted with (an electric resistive) rock welding system and with a cooling system.

FIG. 4A may depict a longitudinal cross-section diagram of a (granitic) waste capsule 9 fitted with (an electric resistive or the like or equivalent or better) rock welding system and with a cooling system 15*a*. In some embodiments, a cooling system 15*a* or cooling jacket 15*a*, may be optionally implemented circumferentially on lower sections of the given waste capsule 9 to cool and/or maintain such lower sections of the waste capsule 9 and its waste material 13 in cavity 11, at a temperature below the melting point of the waste material 13 (which is stored inside the cavity 11). In some embodiments, cooling system 15*a* may be active (e.g., as in a heat pump or refrigeration) and/or passive (e.g., as in a heat sink). In some embodiments, cooling system 15*a* may be utilize one or more of: solid state cooling circuits, fins, radiators, fans, heat pumps, compressors, heat sinks, fluid circulation system, portions thereof, combinations thereof, and/or the like. In some embodiments, cooling system 15*a* may be configured to pull and direct heat away from wall(s) 10 of waste capsule 9. In some embodiments, cooling system 15*a* may be located below heater system elements 15, in a vertical direction, with respect to a given waste capsule 9. In some embodiments, cooling system 15*a* may be in physical communication with lower sections of wall(s) 10 of waste capsule 9. In some embodiments, cooling system 15*a* may be (removably in some embodiments) attached to lower sections of wall(s) 10 of waste capsule 9. In some embodiments, when cooling system 15*a* may be utilized, insulating material 14 may be omitted. In some embodiments, when cooling system 15*a* may be utilized, insulating material 14 may still be utilized. In some embodiments, when cooling system 15*a* may be removable and/or reusable. In some embodiments, when cooling system 15*a* may be disposable.

Continuing discussing FIG. 4A, in some embodiments, heater power and controller 16*a* may provide, control, and/or regulate the electrical energy via electrical heater cable(s) 16*b* to heater system elements 15, which may heat upper portions of wall(s) 10 and cap 12 sufficiently for these upper portions of wall(s) 10 to melt together with portions of cap 12, resulting in a seamless rock weld between cap 12 and the upper portions of wall(s) 10. In some embodiments, the electrically heated heater system elements 15, in close contact with the upper portions of granite wall(s) 10 of waste capsule 9, may distribute the focused directed heat flux efficiently and effectively into the granite materials of upper wall(s) 10 and portions of cap 12, which then increases in temperature as shown and represented by a dash-dash-dash-dot-dot line temperature isotherms 19 in the FIG. 4A. The highest temperature isotherm 19 may be closest to the heat source heater system elements 15 and the isotherms 19 decrease in temperature towards the center of the mass of the given waste capsule 9 as shown in FIG. 4A. In some embodiments, heater system elements 15 may raise the granite temperature above 700 degrees Celsius (or more) to initiate melting of proximate granite. In general, granite melts approximately between 700 degrees Celsius and 830 degrees Celsius depending on the imposed pressures. The directed heat flux from heater system elements 15 may be maintained until the required amount of melting occurs in the top region of the given waste capsule 9 such that cap 12 is seamlessly welded to the upper wall(s) 10. In some preferred embodiments, the heater system elements 15 may raise the granite temperature to 900 degrees Celsius plus or minus 100 degrees Celsius.

At relatively low pressures (e.g., 4,000 psi), the granite melt temperature is about 830 degrees Celsius; whereas, as the pressure increases to 20,000 psi or higher the melt temperature drops to about 700 degrees Celsius. These pressure levels can be routinely implemented by current mechanical or hydraulic pressure loading systems (see e.g., FIG. 3 and its discussion above).

Current types of electric resistive heaters today (2020) are capable of raising temperatures in excess of 3,000 degrees Celsius if needed. For a specific granite type or sample, specific engineering and scientific methods and procedures can optimally determine the operating conditions of temperature and pressure, a-priori, to allow the most effective rock melting operations to be conducted. These may include experimental work and numerical modelling techniques. These optimal conditions of pressure and temperature are then implemented for the specific granitic waste capsule 9 and its waste material 13 (and insulating material 14 in some embodiments) contents. Under continued heating, the granite materials of upper portions of wall(s) 10 and portions of cap 12, the granite temperatures may reach its melting point and thus liquefies and "flows" and "welds" the top and bottom elements of the given waste capsule 9 together, such that the interior cavity 11 and its contents therein (e.g., waste material 13 and insulating material 14 in some embodiments) are entirely and seamlessly sealed inside granite rock materials of wall(s) 10 and cap 12.

Figure 4B:
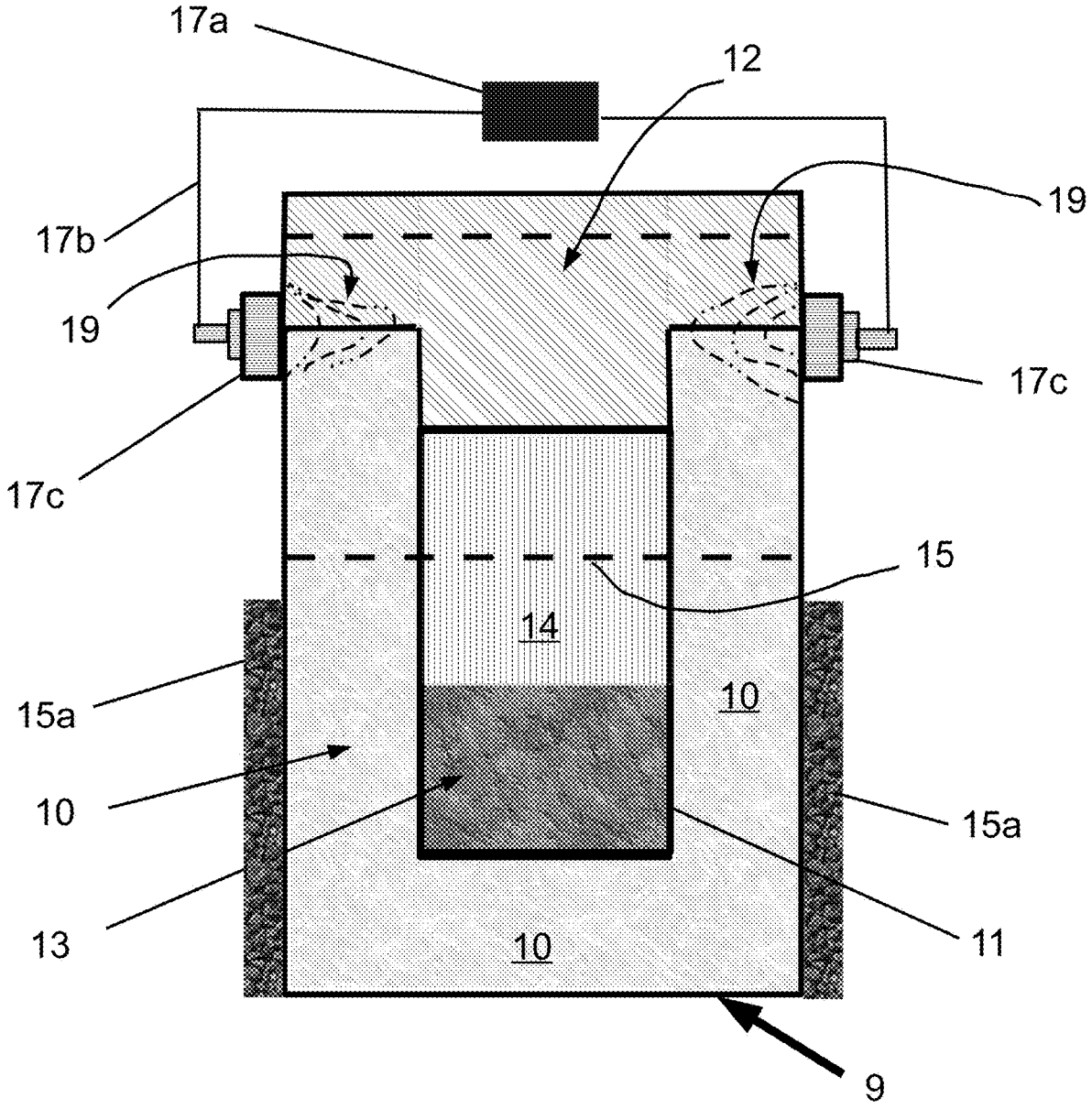
FIG. 4B may depict a longitudinal cross-section diagram of a (granitic) waste capsule fitted with (an electromagnetic (MMW) driven) rock welding system and with a cooling system.

FIG. 4B may depict a longitudinal cross-section diagram of a (granitic) waste capsule 9 fitted with elements 17*a*, 17*b*, and 17*c*) of a millimeter wave (MMW) electromagnetic rock welding system; and in some embodiments, with a cooling system 15*a*.

Continuing discussing FIG. 4B, in some embodiments, a MMW heater controller 17*a* may provide, control, and/or regulate the MMW system, via connectors 17*b*, to MMW heater system elements 17*c*, disposed superficially adjacent to the granite capsule wall 10. In some embodiments, MMW connectors 17*b* may be configured to carry electrical current. In some embodiments, MMW connectors 17*b* may be one or more wires and/or cables. In some embodiments, MMW connectors 17*b* may provide electrical power between MMW power control 17*a* and MMW heat element(s) 17*c*. In some embodiments, MMW connectors 17*b* may operatively connect MMW power control 17*a* to MMW heat element(s) 17*c*. In some embodiments, MMW heater system elements 17*c* may heat with the focused energy, the upper portions of wall(s) 10 and cap 12 sufficiently for these upper portions of wall(s) 10 to melt together with portions of cap 12, resulting in a (substantially seamless) rock weld between cap 12 and the upper portions of wall(s) 10. In some embodiments, the MMW heater system elements 17*c* may be in "close contact" with the upper portions of granite wall(s) 10 of waste capsule 9, may distribute and/or direct at least some of the focused directed heat flux efficiently and effectively into the granite materials of upper wall(s) 10 and portions of cap 12, which then increases in temperature as shown and represented by the dash-dash-dash-dot-dot-lines temperature isotherms 19 in the FIG. 4B. In the present invention, this "close contact" may be different depending on the size of the MMW waveguide and the power of the gyrotron system (or gyrotron like system) used. In some embodiments, this close contact distance may be measured in millimeters (mm) varying from less than 0.5 to 2.0 times the waveguide diameters. In some embodiments, this close contact distance may be a few millimeters (mm) to about 20 mm plus or minus 2 mm, from an edge of a given MMW heater system element 17*c* to a closest wall 10/cap 12 granitic material.

The highest temperature isotherm 19 may be closest to the heat source heater system elements 17*c* and the isotherms 19 may decrease in temperature towards a center of the mass of the given waste capsule 9 as shown in FIG. 4B.

In some embodiments, the MMW heater elements 17*c* may raise the granite 10 temperature above 700 degrees Celsius (or more) in a matter of minutes, between 2 to 15 minutes, depending on the power level of the heater device 17*a*, to initiate melting of the proximate granite. In general, granite melts approximately between 700 degrees Celsius and 830 degrees Celsius depending on the imposed pressures. The directed heat flux from heater system elements 17*c* may be maintained until the required amount of melting occurs in the top region of the given waste capsule 9 such that cap 12 is (substantially seamlessly) welded to the upper wall(s) 10. In some preferred embodiments, the heater system elements 17*c* may raise the granite temperature to 900 degrees Celsius plus or minus 100 degrees Celsius.

Current types of MMW heaters today (2020) are capable of raising temperatures in excess of 3,000 degrees Celsius if needed. For a specific granite type or sample, specific engineering and scientific methods and procedures can optimally determine the operating conditions of temperature and pressure, a-priori, to allow the most effective rock melting operations to be conducted. These may include experimental work and numerical modelling techniques. These optimal conditions of pressure and temperature may then be implemented for the specific granitic waste capsule 9 and its waste material 13 (and insulating material 14 in some embodiments) contents. Under continued heating, the granite materials of upper portions of wall(s) 10 and portions of cap 12, the granite temperatures may reach its melting point and thus liquefies and "flows" and "welds" the top and bottom elements of the given waste capsule 9 together, such that the interior cavity 11 and its contents therein (e.g., waste material 13 and insulating material 14 in some embodiments) are entirely and (substantially seamlessly) sealed inside granite rock materials of wall(s) 10 and cap 12.

Continuing discussing FIG. 4B, in some embodiments of the rock welding processes using the MMW systems, the MMW beam device elements 17*c* may be mechanically rotated around a perimeter/circumference of a given stationary granite capsule 9 to circumferentially weld all portions of the upper capsule wall 10 in the directed path of the MMW beam device elements 17*c*, by focusing the MMW beam on the precise location on those upper capsule wall(s) 10. In some embodiments, the MMW beam device elements 17*c* may be in fixed positions and the capsule 9 may be rotated on a "turntable" like system to allow the full circumference of the upper capsule wall 10 to be contacted by the directed MMW beam devices 17*c*. In embodiment today, the practical rotational applications may be implemented with available and well-known mechanical systems, such as, but not limited to, from industrial machine shops.

In some embodiments, a cooling system 15*a* or cooling jacket 15*a*, may be optionally implemented circumferentially on lower sections/portions of the given waste capsule 9 to cool and/or maintain such lower sections of the given waste capsule 9 and its waste material 13 in cavity 11, at a temperature below the melting point of the waste material 13 (which is stored inside the cavity 11). In some embodiments, cooling system 15*a* may be active (e.g., as in a heat pump or refrigeration) and/or passive (e.g., as in a heat sink). In some embodiments, cooling system 15*a* may be utilize one or more of: solid state cooling circuits, fins, radiators, fans, heat pumps, compressors, heat sinks, fluid circulation system, portions thereof, combinations thereof, and/or the like. In some embodiments, cooling system 15*a* may be configured to pull and direct heat away from wall(s) 10 of waste capsule 9. See e.g., FIG. 4A and/or FIG. 4B.

In some embodiments, cooling system 15*a* may be located below heater system elements 15 and/or below heater elements 17*a*, 17*b*, and 17*c*, in a vertical direction, with respect to a given waste capsule 9. In some embodiments, cooling system 15*a* may be in physical communication with lower sections of wall(s) 10 of waste capsule 9. In some embodiments, cooling system 15*a* may be (removably in some embodiments) attached to lower sections of wall(s) 10 of waste capsule 9. In some embodiments, when cooling system 15*a* may be utilized, insulating material 14 may be omitted. In some embodiments, when cooling system 15*a* may be utilized, insulating material 14 may still be utilized. In some embodiments, cooling system 15*a* may be removable and/or reusable. In some embodiments, cooling system 15*a* may be disposable. See e.g., FIG. 4A and/or FIG. 4B.

In some embodiments, because of the radioactive nature of the high-level waste materials 13 (e.g., HLW and/or WGP) which has to be disposed of, adequate radioactive shielding may be implemented during several phases of the rock welding process discussed above. In some embodiments, radioactive shielding may surround the waste capsule assembly and/or rock welding/cooling systems. In some embodiments, this radioactive shielding which is routine in industrial nuclear practices today may be implemented as part of the rock welding process.

Figure 5A:
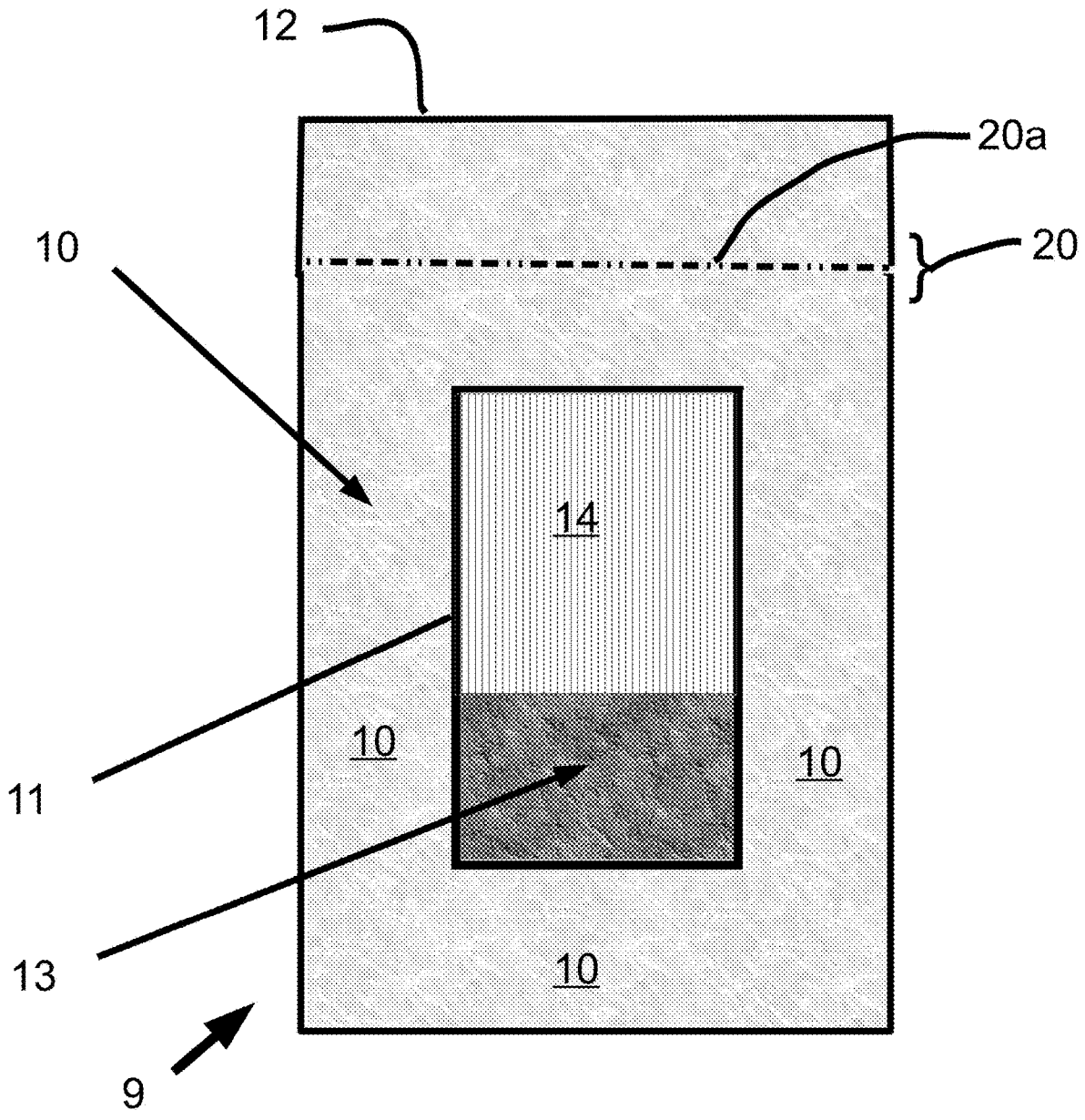
FIG. 5A may depict a longitudinal cross-section diagram of a sealed and seamless (granitic) waste capsule after undergoing rock welding operations.

FIG. 5A may depict a longitudinal cross-section diagram of a sealed and seamless (granitic) waste capsule 9 after undergoing rock welding operations. FIG. 5A may show that cap 12 is now seamless with wall(s) 10 of waste capsule 9, and with waste material 13 (and in some embodiments, with insulating material 14) entirely and completely sealed within this seamless waste capsule 9. As noted, in some embodiments, during the rock welding operations upper portions of wall(s) 10 and cap 12 may be heated and melted by the rock welding system (e.g., via heater system elements 15). In some embodiments, this rock weld process may produce a molten rock phase which is depicted in FIG. 5A with reference numeral 20, denoting "melted and re-solidified rock region 20." In some embodiments, this melted and re-solidified rock region 20 may develop in the upper sections/portions of the given waste capsule 9 undergoing rock welding operations. In some embodiments, a demarcation zone/line 20*a* shows a gradual interface between melted and re-solidified rock region 20 and non-melted zones of wall(s) 10. As melted and re-solidified rock region 20 cools into its re-solidified phase, demarcation zone/line 20*a* may disappear and these upper portions/sections of wall(s) 10 may become homogenous with portions of cap 12, such that a seamless granite medium now completely enshrouds the inner cavity 11 with the encapsulated waste material 13 (and in some embodiments, with insulating material 14) therein.

Figure 5F:
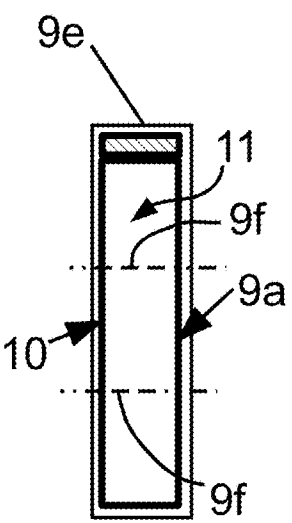
FIG. 5F may depict a longitudinal cross-section diagram of a given waste capsule that may further comprise an exterior/outer protective sheath that may substantially surround the granitic material.
Figure 5E:
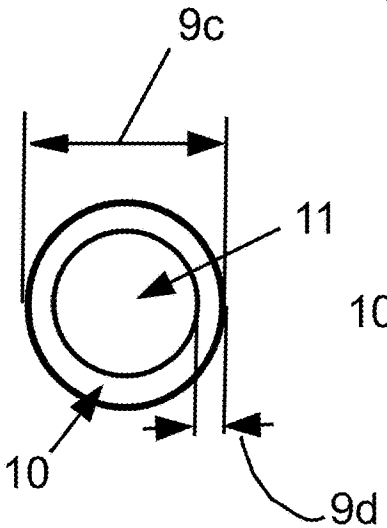
FIG. 5E may depict an outside diameter dimension (or outside width dimension in the case of rectangular prism waste capsules) and/or wall thickness for a given granitic waste capsule.
Figure 5D:
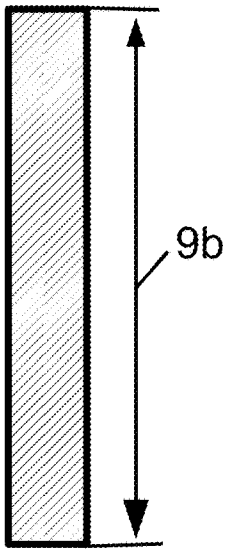
FIG. 5D may depict an overall (fixed/static) length dimension of a given waste capsule.
Figure 5C:
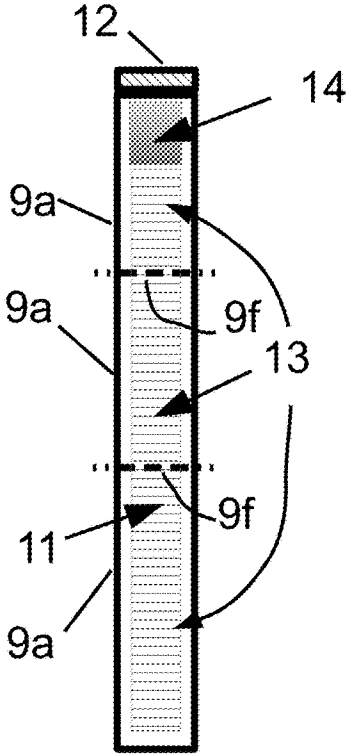
FIG. 5C may depict a longitudinal cross-section diagram of an elongated, longer, and larger overall granitic waste capsule, constructed by rock melting several segments (modules) together end to end (e.g., as in FIG. 5B), and into which waste (such as, but not limited to, WGP and/or HLW) has been loaded.
Figure 5B:
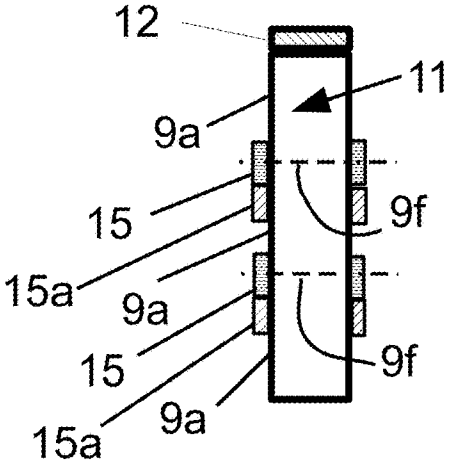
FIG. 5B may depict a longitudinal cross-section diagram of a predetermined quantity of granitic segments (modules) (e.g., cylinders or rectangular prisms) that may be welded together in end-to-end fashion to form an elongated, longer, and larger overall granitic waste capsule.

FIG. 5B may depict a longitudinal cross-section diagram of a predetermined quantity of granitic segments 9*a* (modules) (e.g., cylinders or rectangular prisms) that may be welded together in end-to-end fashion to form an elongated, longer, and larger overall granitic waste capsule 9. In some embodiments, each segment 9*a* may be substantially constructed from a rock, such as, but not limited to, granite. In some embodiments, each segment 9*a* may have its own cavity 11. In some embodiments, each segment 9*a* may be substantially shaped exteriorly as a hollow right cylinder, but without being closed on at least one end. In some embodiments, each segment 9*a* may be substantially shaped exteriorly as a hollow rectangular prism, but without being closed on at least one end. In some embodiments, a given segment 9*a* may be initially open at both opposing ends. In some embodiments, an open end of one segment 9*a* may be rock welded to another and different open end of a different segment 9*a*, using the work welding operations discussed above, wherein an initial demarcation between these two segments 9*a* being rocked welded together may be designated by junction 9*f*. In this manner a given waste capsule 9 may be constructed from two or more segments 9*a* rock welded together end to end, with at least one junction 9*f*. In some embodiments, after welding operations segments 9*a* may be joined together, end to end, in a substantially seamless fashion, with each junction 9*f* being substantially homogeneous with the rock above and below that junction 9*f*. In some embodiments, a bottom segment 9*a* of such a constructed waste capsule 9 may be closed at its bottom end by wall(s) 10. In some embodiments, a bottom segment 9*a* of such a constructed waste capsule 9 may be initially open at its top until sealed by cap 12 via rock welding operations.

In some embodiments, prior to joining (via rock welding) a segment 9*a* to a lower segment 9*a*, that lower segment 9*a* may be loaded with some waste material 13 (and in some embodiments, with insulating material 14). Whereas in other embodiments, waste material 13 (and in some embodiments, insulating material 14) may be loaded into the plurality of interconnected cavities 11 once all the segments 9*a* have been rock welded together, end to end.

FIG. 5C may depict a longitudinal cross-section diagram of an elongated, longer, and larger overall granitic waste capsule 9, constructed by rock melting several segments 9*a* (modules) together end to end (e.g., as in FIG. 5B), and into which waste material 13 (and in some embodiments, insulating material 14) has been loaded. Waste capsule 9 of FIG. 5C, made from two or more segments 9*a*, may have a longer overall cavity 11 than as compared to a waste capsule made from just one segment 9*a*. Such a longer overall cavity 11 of waste capsule 9 of FIG. 5C may accommodate longer waste materials 13, such as, but not limited to, spent fuel assemblies, spend fuel rods, nuclear fuel rods, uranium pellets, portions thereof, combinations thereof, and/or the like.

FIG. 5D may depict an overall (fixed/static) length 9*b* dimension of a given waste capsule 9. In some embodiments, waste capsule 9 may be made from one or more segments 9*a*. In some embodiments, length 9*b* may be fixed and static from three (3) feet to fifteen (15) feet, plus or minus six (6) inches.

FIG. 5E may depict an outside diameter 9*c* dimension (or outside width dimension in the case of rectangular prism waste capsules) and/or wall thickness 9*d* for a given granitic waste capsule 9. In some embodiments, outside diameter 9*c* (cross-section dimension 9*c*) may be fixed and static from six (6) inches to fifteen (15) inches, plus or minus one (1) inch. In some embodiments, wall thickness 9*d* may be fixed and static from one (1) inch to three (3) inches, plus or minus one half (0.5) inch.

FIG. 5F may depict a longitudinal cross-section diagram of a given waste capsule 9 that may further comprise an exterior/outer protective sheath 9*e* that may substantially surround the granitic materials of wall(s) 10, junction(s) 9*f*, and/or cap 12. In some embodiments, outer protective sheath 9*e* may be located on an exterior of a given waste capsule 9. In some embodiments, outer protective sheath 9*e* may substantially enclose a given waste capsule 9. In some embodiments, outer protective sheath 9*e* may substantially enclose rock and/or granitic materials of a given waste capsule 9. In some embodiments, outer protective sheath 9*e* may be located substantially exteriorly to rock and/or granitic materials of a given waste capsule 9. In some embodiments, outer protective sheath 9*e* may be configured to support and/or protect a given waste capsule 9. In some embodiments, outer protective sheath 9*e* may be configured to support and/or protect a given waste capsule 9 during transportation of waste capsule 9 from one location to another location. In some embodiments, outer protective sheath 9*e* may be configured to minimize breakage and/or fracturing of rock and/or granitic materials of a given waste capsule 9. In some embodiments, outer protective sheath 9*e* may help to prevent breakage/fracturing of rock and/or granitic materials of a given waste capsule 9 when loading/landing waste capsules 9 into wellbore(s) 21 and/or into wellbore casing(s) 22 which may terminate within deep geologic repositories 25 (see e.g., FIG. 6). In some embodiments, outer protective sheath 9*e* may be configured to absorb at least some forces from external sources, acting as a shock absorber, to waste capsule 9. In some embodiments, outer protective sheath 9*e* may be substantially constructed from one or more: metals, metal alloys, polymers, elastomers, combinations thereof, and/or the like.

Figure 6:
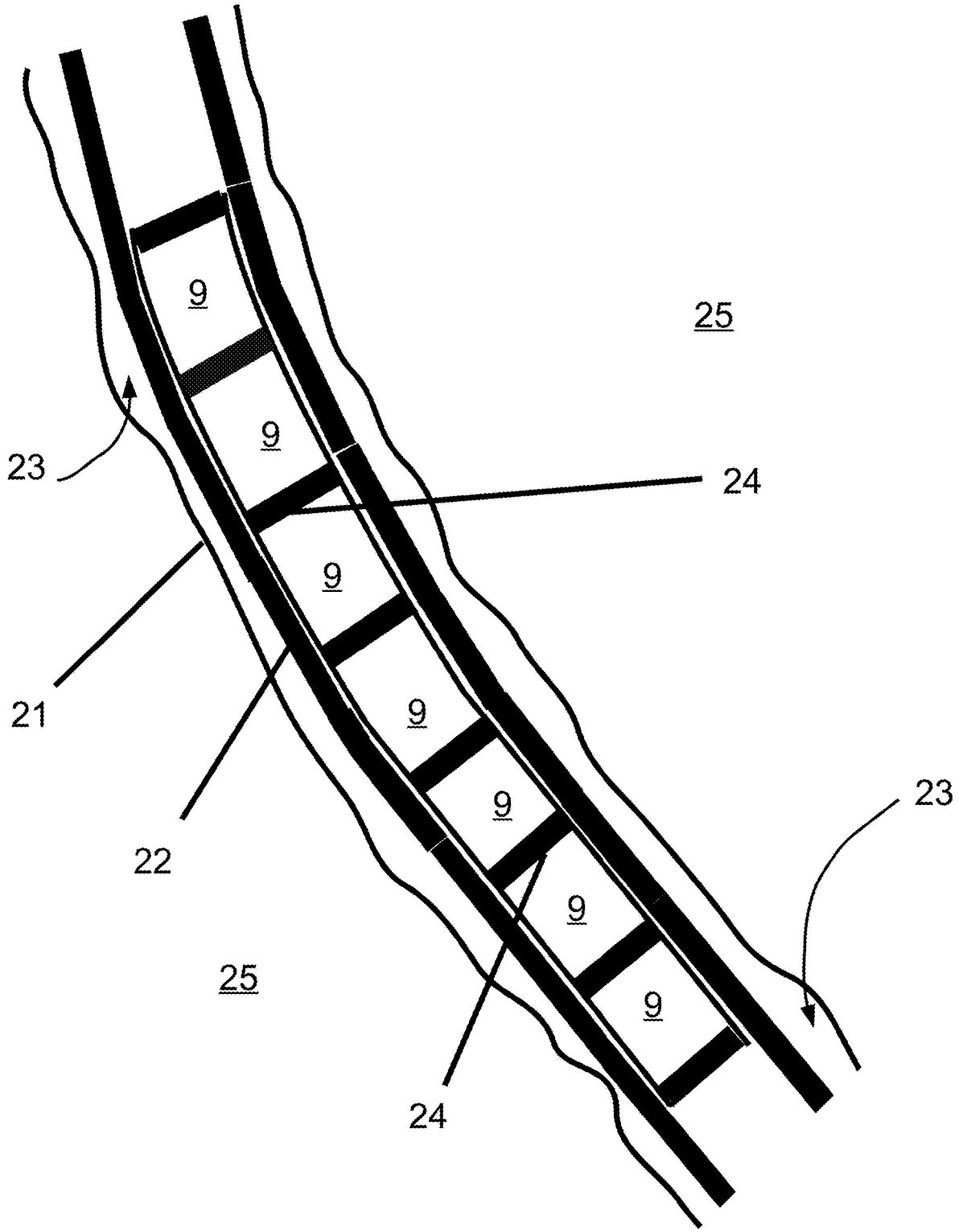
FIG. 6 may depict a predetermined quantity of waste capsules (with waste) located within a given wellbore, wherein that section of wellbore may be located in a given deep geological repository (formation rock).

FIG. 6 may depict a predetermined quantity of waste capsules 9 (with waste material 13) located within a given wellbore 21, wherein that section of wellbore 21 may be located in a given deep geological repository 25 (formation rock 25). Note, the portions of the disposal wellbore system shown in FIG. 6 may be located thousands of feet below the Earth's surface as that may be the location of the given deep geological repository 25. Whereas, upper portions of such disposal wellbore systems, with at least one wellbore leading from the upper portions that are at or near the Earth's surface to the lower portions, may be depicted in FIG. 1 of U.S. patent application Ser. Nos. 15/936,245 and/or 16/191,390; U.S. patent application Ser. Nos. 15/936,245 and/or 16/191,390 are incorporated by reference herein. Note, the schedules of reference numerals used in U.S. patent application Ser. Nos. 15/936,245 and/or 16/191,390 may differ from the schedule of reference numerals used in this instant patent application.

Continuing discussing FIG. 6, in some embodiments, any waste capsule 9 shown in FIG. 6 may be as of any waste capsule 9 as described and discussed above. In some embodiments, each waste capsule shown in FIG. 6 may contain at least some quantity/amount of waste material 13 (and in some embodiments, some insulating material 14).

Continuing discussing FIG. 6, in some embodiments, a given wellbore 21 may be drilled from the Earth's surface and into a given deep geological repository 25 (e.g., using oilfield drilling equipment, which may be modified). In some embodiments, insides of wellbore 21 may then be lined with wellbore casing(s) 22. In some embodiments, wellbore casing(s) 22 may be steel pipe(s) and/or the like. Thus, there may be an annular space between wellbore 21 and wellbore casing(s) 22. In some embodiments, wellbore cement 23 may be pumped into this annular space between wellbore 21 and wellbore casing(s) 22.

Continuing discussing FIG. 6, in some embodiments, at least one waste capsule 9 or a plurality of waste capsules 9 may be located into the disposal wellbore system until the loaded at least one waste capsule 9 (or the plurality of waste capsules 9) at least reaches a depth in the disposal wellbore system, wherein wellbore 21 is surrounded by the given deep geological repository 25. In some embodiments, the at least one waste capsule 9 or the plurality of waste capsules 9 may be inserted (landed) within wellbore 21. In some embodiments, the at least one waste capsule 9 or the plurality of waste capsules 9 may be inserted (landed) within wellbore casing 22.

Continuing discussing FIG. 6, in some embodiments, when two or more waste capsules may be loaded into the given disposal wellbore system, waste capsules 9 that are linearly (axially) adjacent to each other may be linked (connected) to each other via at least one separator 24 (spacer). In some embodiments, use of at least one separator 24 between adjacent waste capsules 9 may provide a predetermined amount of separation between adjacent waste capsules 9. In some embodiments, this predetermined amount of separation between adjacent waste capsules 9 may minimize degradation of the disposal wellbore system and/or of the waste capsules 9. In some embodiments, this predetermined amount of separation between adjacent waste capsules 9 may yield desired heat dissipation within the disposal wellbore system and/or with respect to the waste capsules 9. In some embodiments, when two or more waste capsules may be loaded into the given disposal wellbore system, waste capsules 9 that are linearly (axially) adjacent to each other may be linked (connected) to each other via at least one coupler. In some embodiments, the at least one separator 24 may be a same component as the at least one coupler. In some embodiments, the at least one separator 24 may be a different component from the at least one coupler.

Continuing discussing FIG. 6, in some embodiments, the plurality of waste capsules 9 may be connected or coupled sequentially and linearly to form an integral unit quite similar to a "string of pipe" units commonly used in the oil and gas industry. This string of waste capsules 9 may form a "capsule string." In some embodiments, this capsule string may be "landed" or inserted into wellbore(s) 21 and/or into wellbore casing(s) 22, which may be at least partially located within the given formation rock 25 (deep geological repository 25). In some embodiments, this capsule string system may allow the plurality of waste capsules 9 (and their separators 24 and/or couplings) to form a longer cylindrical unit which may be implemented simultaneously by surface well servicing operations as an integral string or "unit." This type of operation is very typical of the oilfield industry field processes with respect to pipe. This familiarity and commonality of widespread use allows the subject invention to be implemented herein to be utilized extremely economically today without the need to devise or re-invent a whole new set of expensive and unproved operational techniques.

Figure 7:
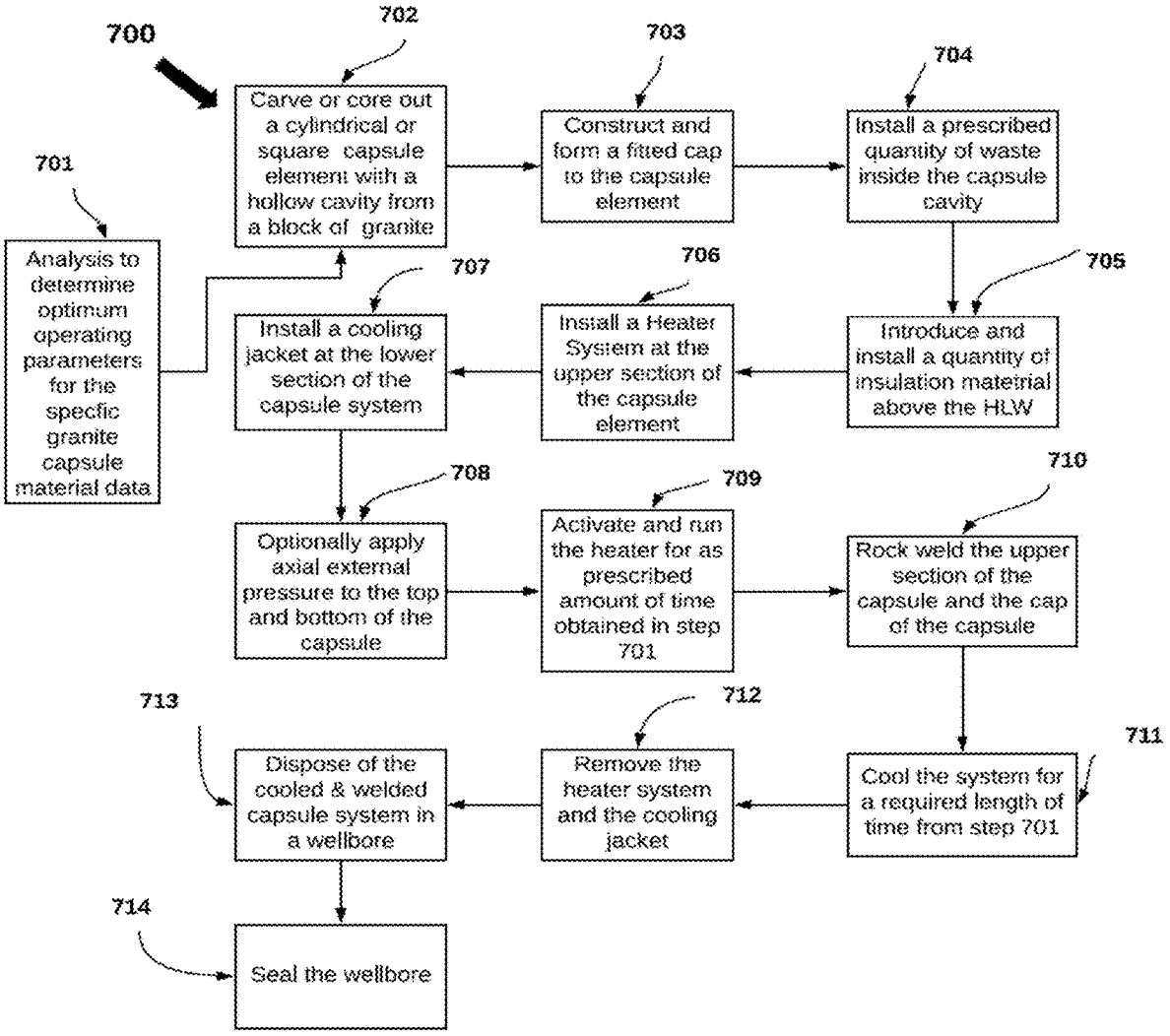
FIG. 7 may illustrate a flow chart of a method for forming and using granitic waste capsules for the disposal of dangerous waste, such as, but not limited to, WGP and/or HLW.

FIG. 7 may illustrate a flow chart of a method 700 for forming and using granitic waste capsules 9 for the disposal of dangerous waste materials 13, such as, but not limited to, WGP and/or HLW. In some embodiments, method 700 may a method of rock welding to form a seamlessly sealed waste capsule 9 (with waste material 13 and possibly also with insulating material 14) and of then disposing of that seamlessly sealed waste capsule 9 within a disposal wellbore system (e.g., with wellbore 21 and possibly with wellbore casing 22) that is at least partially located within a given deep geological repository 25. In some embodiments, method 700 may be a method for waste capsule 9 construction by at least in part rock welding and/or rock melting and subsequent cooling. In some embodiments, method 700 may be a method for disposing of waste capsule 9. In some embodiments, method 700 may comprise at least one step selected from steps of: 701, 702, 703, 704, 705, 706, 707, 708, 709, 710, 711, 712, 713, 714, portions thereof, combinations thereof, and/or the like. Some embodiments of 700 may omit one or more of these steps. Some embodiments of 700 may repeat at least one of these steps.

Continuing discussing FIG. 7, in some embodiments, step 701 may be a step of determining and/or analyzing operational parameters necessary to melt the specific/particular granite rock material(s) of which a given waste capsule 9 may be constructed from. In some embodiments, this step 701 may comprise finite element analysis and/or computer simulation/modeling methods of the heating (rock welding) and/or cooling processes. In some embodiments, inputs into such finite element analysis and/or computer simulation/modeling methods may comprise one or more of: parameters associated with the specific/particular type of rock (e.g., granite) to be welded; density of the specific/particular type of rock (e.g., granite) to be welded; shape/geometry of the specific/particular type of rock (e.g., granite) to be welded; mass of the specific/particular type of rock (e.g., granite) to be welded; wall thickness of the specific/particular type of rock (e.g., granite) to be welded; length of the specific/particular type of rock (e.g., granite) to be welded; width/diameter of the specific/particular type of rock (e.g., granite) to be welded; water content of the specific/particular type of rock (e.g., granite) to be welded; whether a cooling system 15*a* may be included; parameters of the loaded waste material(s) 13 (e.g., type, amount, mass, locations, packing configuration, density, melt temperature, and/or the like) within a given cavity 11; parameters of the loaded insulating material(s) 14 (e.g., type, locations, density, and/or the like) (if any) within a given cavity 11; combinations thereof, and/or the like. In some embodiments, the results from such finite element analysis and/or computer simulation/modeling methods may comprise one or more of: electric power output for the rock welding system; target temperature level(s) to reach; heating time(s); cooling time(s); axial (pre-loading) pressure parameters (confining pressure 18); combinations thereof, and/or the like. In some embodiments, these results may vary with the dimensional sizes, shapes, geometry, mass, density of the given waste capsule 9. In some embodiments, method 700 may not include step 701. In some embodiments, step 701 may progress/lead into step 702.

Continuing discussing FIG. 7, in some embodiments, step 702 may be a step of forming at least one wall(s) 10, with an internal cavity 11 from a larger source material of rock (e.g., from a given granite block 8). In some embodiments, step 702 may be a step of forming at least one segment 9*a*, with an internal cavity 11 from a larger source material of rock (e.g., from a given granite block 8). In some embodiments, in step 702, a plurality of segments 9*a* (each with its own internal cavity 11) may be formed from a larger source material of rock (e.g., from a given granite block 8). In some embodiments, step 702 may involve cleaning, cutting, coring, drilling, machining, grinding, polishing, combinations thereof, and/or the like operations on the given larger source material of rock (e.g., from a given granite block 8) to generate the one or more segments 9*a* (each with its own internal cavity 11). In some embodiments, in step 702, a commercially available granite block 8 may be utilized and prepared for coring by cleaning and machining the outside surfaces to allow for ease of coring and cutting. In some embodiments step 702 may be the step of coring an initial inner core in the granite block 8 using a commercially available core barrel device. In some embodiments, this formed inner core (e.g., cavity 11) may be from five (5) inches to nine (9) inches in diameter, plus or minus one (1) inch. In some embodiments, this core process may not extend to a bottom of the given granite block 8 but allows a portion of the granite to remain forming a base as in wall 10, see e.g., FIG. 1E. In some embodiments, this inner core material is removed leaving a void space that may be cavity 11 in the granite block 8, see e.g., FIG. 1E. In some embodiments, cavity 11 may have an inside/interior fixed and static diameter of five (5) inches to nine (9) inches in diameter, plus or minus one (1) inch. In some embodiments, step 702 may be an additional step of drilling/cutting an outer core around the inner core, which may generate exterior vertical wall(s) 10 of a given waste capsule 9. In some embodiments, the outer core (e.g., outer diameter 9*c*) may be fixed and static from six inches to 15 inches in diameter. Formation of the outer core (that may form exterior vertical wall(s) 10) may entail drilling through the bottom of the given granite block 8. This process may form a complete lower section/portion of the given waste capsule 9 (or a complete lower section/portion of a given segment 9*a*). Note, in generating some segments 9*a* from a given granite block 8, both the inner and the outer coring/drilling operations may cut through the bottom of granite block 8; i.e., to generate a segment 9*a* that is initially open at both opposing ends. See e.g., FIG. 1A through FIG. 1E and FIG. 5A. In some embodiments, step 702 may progress/lead into step 703.

Continuing discussing FIG. 7, in some embodiments, step 703 may be a step of constructing/forming a given cap 12 of a predetermined material (e.g., a particular/specific type of rock, such as, but not limited to, granite), size, and shape to fit, attach, and/or seal a top of a given open waste capsule 9, with its cavity 11. In some embodiments, in step 703, cap 12 may be cut, machined, shaped, grinded, cleaned, polished, combinations thereof and/or the like to fit the open cavity 11 at a top of a given waste capsule 9. In some embodiments, cap 12 may be made from substantially a same type of material as the given waste capsule 9 that this cap 12 is intended to fit to. In some embodiments, step 703 may progress/lead into step 704.

Continuing discussing FIG. 7, in some embodiments, step 704 may be a step of loading/inserting/filling at least some waste material 13 into a given cavity 11 of a given waste capsule 9. In some embodiments, step 704 may be a step of loading/inserting/filling at least some waste material 13 into a given cavity 11 of a given segment 9*a*. In some embodiments, an amount and/or a type of waste material 13 that may be loaded/inserted/filled into the given cavity 11, may be predetermined. In some embodiments, the waste material 13 that may be loaded/inserted/filled into the given cavity 11, may be located towards a bottom of that given cavity 11 (i.e., disposed away from a top opening and/or cap 12). Different waste forms of waste material 13, as described earlier, may be disposed of depending on cavity 11 sizing. In some embodiments, step 704 may progress/lead into step 705.

Continuing discussing FIG. 7, in some embodiments, step 705 may be a step of installing and/or placing a prescribed quantity of insulating material 14 above the installed quantity of waste material 13 within the given cavity 11. In some embodiments, step 705 may progress/lead into step 706. In some embodiments, step 705 may be omitted, in which case, step 704 may progress into step 706.

Continuing discussing FIG. 7, in some embodiments, step 706 may be a step of installing and sealing cap 12 to the top/upper portions of wall(s) of a given waste capsule 9, that is housing waste material 13 within cavity 11 (in some embodiments, that cavity 11 may also include at least some insulating material 14). In some embodiments, step 706 may at least partially entail placing cap 12 onto a top of wall(s) 10 of the given waste capsule 9. In some embodiments, step 706 may at least partially entail attaching cap 12 onto a top of wall(s) 10 of the given waste capsule 9 (e.g., with insert 12*a* into a top of cavity 11). In some embodiments, step 706 may at least partially entail press/friction fitting cap 12 onto a top of wall(s) 10 of the given waste capsule 9 (e.g., with insert 12*a* into a top of cavity 11). In some embodiments, after cap 12 is in physical communication with the upper portions of wall(s) 10, then the rock welding system may be implemented (removably so in some embodiments), with heater system elements 15 and/or 17*c* directed to emit heat into the upper portions of wall(s) 10 and into portion of fitted cap 12 (see e.g., FIG. 2 and FIG. 4). In some embodiments, step 706 may be a step of (removably) installing the external circumferential heater system elements 15 and/or 17*c*, as illustrated in FIG. 2, FIG. 4A, and in FIG. 4B, to the given waste capsule 9. In some embodiments, these external heater system elements 15 and/or 17*c* are (removably) attached to the upper sections/portions of wall(s) 10 and to portions of cap 12 that are proximate where cap 12 mates up against the upper sections/portions of wall(s) 10. In some embodiments, these heater system elements 15 may have its power/heater cables 16*b* and its power controller 16*a* implemented to control and monitor the heating (rock welding) operations (see e.g., FIG. 2 and/or FIG. 4A). In some embodiments, these heater system elements 17*c* may have its power/heater connectors 17*b* and its power controller 17*a* implemented to control and monitor the heating (rock welding) operations (see e.g., FIG. 4B). In some embodiments, step 706 may progress/lead into step 707.

Continuing discussing FIG. 7, in some embodiments, step 707 may be a step of installing external cooler system 15*a* as illustrated in FIG. 4A and/or in FIG. 4B. In some embodiments, this external cooler system 15*a* may be (removably) attached to the lower sections/portions of wall(s) 10 of the given waste capsule 9 (segment 9*a*). In some embodiments, this cooler apparatus 15*a* may be implemented to control and monitor cooling operations (if any), such that the bottom of the waste capsule 9 and/or the cavity 11 and its contents (e.g., waste material 13) remain below the melting temperature of the waste material 13. In some embodiments, step 707 may progress/lead into step 708. In some embodiments, step 707 may be omitted, in which case step 706 may progress to step 708 or to step 709.

Continuing discussing FIG. 7, in some embodiments, step 708 may be a step of applying an axial pressure (load), such as confining pressure 18, to opposing ends of a given waste capsule 9 (with cap 12), such that the melting point of the granite materials of waste capsule 9 may be lowered. In some embodiments, step 708 may progress/lead into step 709. In some embodiments, step 708 may be omitted, in which case step 707 (or step 706) may progress into step 709.

Continuing discussing FIG. 7, in some embodiments, step 709 may be a step of activating and operating the heater system elements 15 and/or 17*c*. In some embodiments, step 709 may be a step of activating and then operating the heater system elements 15 and/or 17*c* for a predetermined amount of time. In some embodiments, step 709 may be a step of activating and then operating the heater system elements 15 and/or 17*c* for a computed amount of time as determined in step 701 above. In some embodiments, step 709 may progress/lead into step 710.

Continuing discussing FIG. 7, in some embodiments, step 710 may be a step of rock-welding the upper/top portions/section of wall(s) 10 to complimentary portions of cap 12, resulting in a region of homogeneous rock (granitic) material (e.g., melted and re-solidified rock region 20), that forms a completely sealed waste capsule 9, with its cap 12 being seamlessly welded to wall(s) 10; e.g., as illustrated in FIG. 5A. In some embodiments, step 710 may utilize the rock welding system (e.g., the heater system elements 15 and/or 17*c*). In some embodiments, depending on the type of rock weld system (e.g., electric resistive and/or MMW beam), this process of welding (melting) the rock (granitic) materials (upper/top portions of wall(s) 10 and complimentary portions of cap 12) may require up to several hours of continued heating activation as pre-determined in step 701. In some embodiments, step 710 may progress/lead into step 711.

Continuing discussing FIG. 7, in some embodiments, step 711 may be a step of cooling the previously heated waste capsule 9. In some embodiments, step 711 may be a step of cooling the previously heated waste capsule 9 for a predetermined amount of time as determined initially in step 701. In some embodiments, step 711 may overlap at least in part with step 710. In some embodiments, step 711 may progress/lead into step 712. In some embodiments, step 711 may be optional, in which case, step 710 may progress to step 712 or to step 713.

Continuing discussing FIG. 7, in some embodiments, step 712 may be a step of removing the rock welding system (e.g., heater system elements 15 and/or 17*c*) and/or of removing any cooling system 15*a* in place, from the given waste capsule 9. In such embodiments, the rock welding system (e.g., heater system elements 15 and/or 17*c*), the cooling system 15*a*, portions thereof, combinations thereof, and/or the like may be reusable for other waste capsules 9. In some embodiments, step 712 may progress/lead into step 713.

In some embodiments, the rock welding system (e.g., heater system elements 15 and/or 17*c*), the cooling system 15*a*, portions thereof, combinations thereof, and/or the like may be left in place on/attached to the given waste capsule 9 and not removed. In such embodiments, the rock welding system (e.g., heater system elements 15), the cooling system 15*a*, portions thereof, combinations thereof, and/or the like may be one-time use and/or disposable. In some embodiments, step 712 may be omitted and step 711 or step 710 may progress to step 713.

Continuing discussing FIG. 7, in some embodiments, step 713 may be a step of disposing of the given at least one (granite) waste capsule 9, with its internal waste material 13, in a given wellbore 21 (or in a given wellbore casing 22) that is located within a deep geological repository 25 (see e.g., FIG. 6). In some embodiments, step 713 may be a step of disposing of a plurality of (granite) waste capsules 9, each with its internal waste material 13, in a given wellbore 21 (or in a given wellbore casing 22) that is located within a deep geological repository 25 (see e.g., FIG. 6). In some embodiments, step 713 may be a step of disposing of a capsule string of a plurality of (granite) waste capsules 9, each with its internal waste material 13, in a given wellbore 21 (or in a given wellbore casing 22) that is located within a deep geological repository 25 (see e.g., FIG. 6). At least some prior steps of method 700 may be repeated to generate a plurality of (granite) waste capsules 9, each with its internal waste material 13. In some embodiments, in step 713 outer protective sheath 9*e*, as illustrated in FIG. 5F, may be positioned around a given waste capsule 9 during transportation and/or disposal of the given waste capsule 9. In some embodiments, step 713 may require that the disposal wellbore system of wellbore(s) 21 (and with wellbore casing(s) 22 in some embodiments) be formed, with at least one some of wellbore(s) 21 being located within the given deep geological repository 25. In some embodiments, step 713 may progress/lead into step 714.

Continuing discussing FIG. 7, in some embodiments, step 714 may be a step of sealing the wellbore(s) 21 that may lead to waste capsule(s) 9 located within the given deep repository 25. In some embodiments, step 714 may utilize various concrete plugs for such sealing operations. Once the relevant wellbore(s) 21 are sealed, the disposed of waste material 13 may be out of reach to harm people and/or the environment.

A nuclear waste disposal system and method has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of forming and disposing of at least one rock welded waste capsule, wherein the method comprises steps of:

(a) forming rock side walls of the at least one rock welded waste capsule, wherein the rock side walls bound a cavity, wherein the cavity is configured to receive at least some amount of radioactive material;

(b) forming a rock bottom of the at least one rock welded waste capsule, wherein the rock bottom is integral with a lower most portion of the rock side walls and the rock bottom is configured to prevent the at least some amount of radioactive material from falling out of the at least one rock welded waste capsule;

(c) forming a rock cap that is shaped and sized to press fit to a top of the rock side walls to cover over the cavity; wherein the rock side walls, the rock bottom, and the rock cap are all substantially constructed from a same type of rock;

(d) loading the at least some amount of radioactive material into the cavity;

(e) rock welding the rock cap to the top of the rock side walls using a rock welding system that uses a resistive melting means and/or a millimeter wave melting means to melt the rock cap to the top of the rock side walls, wherein completion of the step (e) results in the at least one rock welded waste capsule being fully formed and sealed; and (f) inserting the at least one rock welded waste capsule from the step (e) into a wellbore that is at least partially located within a deep geological repository, wherein the deep geological repository is located at least 10,000 feet below a surface of the Earth.

2. The method according to claim 1, wherein an exterior of the at least one rock welded waste capsule is substantially shaped as a right cylinder or as a rectangular prism.

3. The method according to claim 1, wherein the cavity is substantially shaped as a right cylinder.

4. The method according to claim 1, wherein a length of the cavity is shorter than an overall exterior length of the at least one rock welded waste capsule.

5. The method according to claim 1, wherein the cavity has a fixed and a static diameter that is selected from a range of five inches to nine inches, plus or minus one inch.

6. The method according to claim 1, wherein an outside diameter or an outside width of the at least one rock welded waste capsule is fixed, static, and selected from a range of six inches to fifteen inches, plus or minus one inch.

7. The method according to claim 1, wherein the at least one rock welded waste capsule has a thickness of the side walls that is fixed and static and that is selected from a range of one inch to three inches, plus or minus one half inch.

8. The method according to claim 1, wherein the at least one rock welded waste capsule has an overall exterior length that is fixed and static and that is selected from a range of three feet to fifteen feet, plus or minus six inches.

9. The method according to claim 1, wherein the rock side walls and the rock bottom are formed from a same larger rock.

10. The method according to claim 1, wherein the radioactive material is selected from one or more of: an amount of plutonium, an amount of weapons grade plutonium, an amount of high level nuclear waste, an amount of uranium, an amount of depleted uranium, a nuclear fuel rod, a nuclear fuel rod assembly, a nuclear fuel rod subassembly, a portion of the nuclear fuel rod, a portion of the nuclear rod assembly, a portion of the nuclear fuel rod subassembly, radioactive pellets, derivatives thereof, combinations thereof, or portions thereof.

11. The method according to claim 1, wherein the same type of rock is selected from granite or another igneous rock.

12. The method according to claim 1, wherein the rock welding system comprises heater elements, a controller, and cables; wherein the cables operationally link the heater elements to the controller; wherein heater elements comprise the resistive melting means and/or the millimeter wave melting means.

13. The method according to claim 12, wherein during the step (e), the controller directs electrical power from an electrical power source to the heater elements, via the cables, so that the heater elements emit heat directed at an external junction of where the rock cap is in physical communication with the top of the rock side walls resulting in melting and welding of the rock cap to the top of the rock side walls.

14. The method according to claim 12, wherein during the step (e), the heater elements are in physical communication with an external junction of where the rock cap is press fit to the top of the rock side walls.

15. The method according to claim 14, wherein prior to the step (f), the heater elements are removed from proximity with respect to the at least one rock welded waste capsule.

16. The method according to claim 1, wherein prior to the step (f), the method further comprises a step of cooling the at least one rock welded waste capsule using a cooling system that is directed at removing at least some heat from the at least one rock welded waste capsule.

17. The method according to claim 16, wherein the step of cooling occurs during the step (e) and/or after the step (e).

18. The method according to claim 16, wherein prior to the step (f), the cooling system is removed from proximity with respect to the at least one rock welded waste capsule.

19. The method according to claim 1, wherein after the step (d) but before the step (e), the method further comprises a step of loading an amount of insulating material into the cavity to protect the at least some amount of radioactive material from heat during the step (e).

20. The method according to claim 1, wherein the rock side walls in the step (a) are formed from two or more segments of elongate rock members with hollow interiors that are rocked welded together in an end to end fashion, using the rock welding system or using another rock welding system, wherein the cavity is formed from the hollow interiors.

* * * * *